US009242777B2

(12) United States Patent
Williams-Hartman

(10) Patent No.: US 9,242,777 B2
(45) **Date of Patent: *Jan. 26, 2016**

(54) THEFT-RESISTANT AND SENIOR-FRIENDLY PACKAGING OF CONSUMER PRODUCTS

(71) Applicant: Key-Pak Technologies, LLC, Wayne, NJ (US)

(72) Inventor: Wade E. Williams-Hartman, Wayne, NJ (US)

(73) Assignee: Key-Pak Technologies, LLC, Wayne, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/038,475

(22) Filed: Sep. 26, 2013

(65) Prior Publication Data

US 2014/0166523 A1 Jun. 19, 2014

Related U.S. Application Data

(63) Continuation of application No. 13/046,930, filed on Mar. 14, 2011, now Pat. No. 8,544,650, which is a continuation of application No. 12/001,302, filed on Dec. 10, 2007, now Pat. No. 7,905,355, which is a continuation-in-part of application No. 11/175,983, filed on Jul. 6, 2005, now Pat. No. 7,448,496, which is a continuation-in-part of application No. 10/799,199, filed on Mar. 12, 2004, now Pat. No. 7,063,211, which is a continuation-in-part of application No. 10/394,495, filed on Mar. 20, 2003, now Pat. No. 7,188,728.

(51) Int. Cl.
*B65D 75/36* (2006.01)
*B65D 73/00* (2006.01)

(52) U.S. Cl.
CPC ..... *B65D 73/0035* (2013.01); *B65D 75/36* (2013.01)

(58) Field of Classification Search
CPC ..... B65D 73/0035; B65D 75/36
USPC ..... 206/531, 532, 538, 539
See application file for complete search history.

(56) References Cited

U.S. PATENT DOCUMENTS

| | | | |
|---|---|---|---|
| 3,610,410 | A | 10/1971 | Seeley |
| 3,809,221 | A | 5/1974 | Compere |
| 3,811,564 | A | 5/1974 | Braber |
| 4,125,190 | A | 11/1978 | Davie, Jr. et al. |
| 4,294,361 | A | 10/1981 | Margulies et al. |
| 4,398,634 | A | 8/1983 | McClosky |
| 4,506,789 | A | 3/1985 | Dlugosz |
| 4,537,312 | A | 8/1985 | Intini |
| 4,567,986 | A | 2/1986 | Eastwood |
| 4,889,236 | A | 12/1989 | Bartell et al. |
| 4,988,004 | A | 1/1991 | Intini |
| 5,046,618 | A | 9/1991 | Wood |
| 5,088,603 | A | 2/1992 | Kirkpatrick |

(Continued)

*Primary Examiner* — Bryon Gehman
(74) *Attorney, Agent, or Firm* — Bakos & Kritzer

(57) ABSTRACT

The present invention is a novel, theft-resistant, and senior-friendly packaging for consumer and retail products that is cheap and easy to manufacture. The packaging is designed to prevent individuals from gaining access to the enclosed product through tampering with the packaging while at the same time meeting or exceeding federal child-resistant and senior-friendly guidelines. The packaging incorporates plastic material and multiple cuts to be tear-resistant and to halt the propagation of a tear, if one should occur.

18 Claims, 17 Drawing Sheets

(56) References Cited

U.S. PATENT DOCUMENTS

| | | | |
|---|---|---|---|
| 5,172,812 | A | 12/1992 | Wharton et al. |
| 5,310,060 | A | 5/1994 | Bitner et al. |
| 5,325,968 | A | 7/1994 | Sowden |
| 5,339,960 | A | 8/1994 | Price |
| 5,469,968 | A | 11/1995 | Matthews et al. |
| 5,511,665 | A | 4/1996 | Dressel et al. |
| 5,758,774 | A | 6/1998 | Leblong |
| 5,775,505 | A | 7/1998 | Vasquez et al. |
| 5,785,180 | A | 7/1998 | Dressel et al. |
| 5,862,915 | A | 1/1999 | Plezia et al. |
| 5,878,888 | A | 3/1999 | Faughey et al. |
| 5,894,930 | A | 4/1999 | Faughey et al. |
| 5,927,500 | A | 7/1999 | Godfrey et al. |
| 5,944,191 | A | 8/1999 | Ray et al. |
| 6,161,699 | A | 12/2000 | Gartland |
| 6,273,260 | B1 | 8/2001 | ColDepietro et al. |
| 6,338,407 | B2 | 1/2002 | Danville |
| 6,394,275 | B1 | 5/2002 | Paliotta et al. |
| 6,422,391 | B1 | 7/2002 | Swartz |
| 6,675,972 | B2 | 1/2004 | Patterson |
| 6,705,467 | B1 | 3/2004 | Kancsar et al. |
| 6,776,285 | B2 | 8/2004 | Shibata |
| 7,188,728 | B2 | 3/2007 | Williams-Hartman |
| 7,389,907 | B2 | 6/2008 | Smith |
| 7,448,496 | B2 | 11/2008 | Williams-Hartman |
| 7,506,761 | B2 | 3/2009 | Levy |
| 7,905,355 | B2 | 3/2011 | Williams-Hartman |
| 8,544,650 | B2 | 10/2013 | Williams-Hartman |
| 2008/0308449 | A1 | 12/2008 | Intini |

THEFT-RESISTANT AND SENIOR-FRIENDLY PACKAGING OF CONSUMER PRODUCTS

CROSS-REFERENCE TO RELATED APPLICATIONS

This application is a continuation application of U.S. patent application Ser. No. 13/046,930, filed on Mar. 14, 2011, now U.S. Pat. No. 8,544,650, issued on Oct. 1, 2013, which is a continuation of U.S. patent application Ser. No. 12/001,302, filed on Dec. 10, 2007, now U.S. Pat. No. 7,905,355, issued Mar. 15, 2011, which is a continuation-in-part of U.S. patent application Ser. No. 11/175,983, filed on Jul. 6, 2005, now U.S. Pat. No. 7,448,496, issued Nov. 11, 2008, which is a continuation-in-part of U.S. patent application Ser. No. 10/799,199, filed on Mar. 12, 2004, now U.S. Pat. No. 7,063,211, issued Jun. 20, 2006, which is a continuation-in-part of U.S. patent application Ser. No. 10/394,495, filed on Mar. 20, 2003, now U.S. Pat. No. 7,188,728, issued Mar. 13, 2007, and the foregoing applications are herein incorporated by reference in their entirety.

FIELD OF THE INVENTION

The present invention relates generally to an improved system and method for packaging consumer products. Specifically, the present invention relates to enhanced retail and consumer packaging designs that incorporate tear resistant materials and tear-stop cuts into the packaging. These tear resistant materials and cuts may be adapted to reduce theft, product tampering, or product degradation. In addition, the present invention relates generally to packaging designs that facilitate clean product dispensement, while at the same time increasing the senior-friendly and child-resistant qualities of the package.

BACKGROUND OF THE INVENTION

One convenient form of retail packaging is blister card packaging. Blister card packages are commonly used for the distribution of many retail and consumer products, including pharmaceutical drugs, batteries, sewing kits, toy cars, electronic and cellular accessories, personal care products, hardware, tools, cosmetics, office supplies, and more. Blister card packaging provides an inexpensive, yet versatile form of product distribution. Blister packaging, in its simplest form, comprises two vital components: a thermoformed blister and a paperboard blister card. The thermoformed blister is typically a translucent chamber made out of some variety of plastic (or other suitable material). The blister houses the product to be distributed using the blister packaging. The blister card is the stiffener or backing sheet for the blister packaging and the product contained within the blister. Typically, the blister card is comprised of pre-printed stiff paper, such as cardboard or paperboard. Paperboard can include any product containing paper (or its derivatives and blends) with a typical thickness of 10 points (0.25 mm) or more, layers of paper, laminated paper, or cardboard. The blister card is usually folded to create at least two adjacent sides. One or both of the sides typically contain an aperture. The product to be packaged is usually encased within an individual blister, which may be inserted between the two adjacent sides of the blister card such that the product protrudes from one or both apertures. The flange area of the blister and the two blister card sides are then sealed, typically using a blister machine. This machine introduces heat and pressure to the flange area of the blister, which may activate glue applied to the blister card. Ultimately, the individual blister is secured to the blister card, and the plastic blister is retained within its blister card packaging.

Blister card packages may accommodate individual products in individual blisters (as described above) or may be designed to accommodate multiple products or multiple applications of a similar product. Typically, separate products or multiple applications of a similar product are housed in blister strips or solid-form blisters. Small objects, such as pharmaceutical drugs, candy, and batteries, are often distributed in this manner. A blister strip comprises a contiguous row of plastic blisters having a common backing, such as paper or foil. The common backing is usually one product unit wide by any number of product units long. In contrast, solid-form blisters comprise a matrix or grid of both horizontal and vertical rows of blisters. As with blister strips, solid-form blisters also typically share a common backing.

Many of the existing, patented blister card packages were originally designed for distribution of non-lethal pharmaceutical drugs. To sell to a larger market of users, these blister card packages were modified to achieve the federal testing guidelines for child-resistance using a variety of methods. These methods included adding paperboard layers, adding plastic or tape layers to the exterior of the paperboard, reinforcing a frangible foil backing with a less frangible paper, etc. As a result, many blister card packages exist today that have passed federal child-resistant and senior-friendly testing guidelines.

After the aforementioned modifications were made, many blister card packages that were previously non-child-resistant were able to pass child resistance testing; however, the packaging became undesirable in several other ways. For example, the additional reinforced layers often prevented the product from being pushed cleanly through the blister backing. Specifically, some blister card package manufacturers added a layer of paper to the foil backing through which the product is pushed. This paper and/or foil backing does not tear cleanly. As a result, the user has to scrape the backing until enough of the backing is removed to allow the user to grasp and peel the backing to reach the product. This can be very difficult, especially for senior citizens or other adults with impaired physical abilities.

Furthermore, once the backing is grasped and torn, a user can easily tear too much backing. This excessive tearing is undesirable, especially when blister strips or solid-form blisters are used. The tearing may run into an adjacent blister, allowing another product or item to be prematurely dispensed. Additionally, the user may not be able to scrape enough backing to the point where the backing may be pulled away, causing the user to utilize a sharp object such as a knife or scissors. Cutting of the blister card packaging can lead to many more problems, including unintentional damage to the product, damage to the printed instructions on the packaging, or injury to the person.

Alternatively, if a user cannot remove the reinforced layer of the blister backing and easily push the product through the non-reinforced layer of the blister backing, the user may attempt to force the product through the reinforced backing. This leads to at least two major problems. First, the content of the blister may be damaged and unusable. Second, the user may resort to bending the overall blister card package causing damage to the blister, the blister card, or the content of the blisters.

Conventional blister card packages also exhibit many other undesirable qualities. For example, the use of large blister card packages is commonplace in the retail marketplace for displaying products for sale. These plastic blisters are often combined with a paperboard backing which allows the consumer to easily view the product through a clear package. These blister card packages are prone to theft and product tampering because the paperboard backing can easily be torn and the item contained therein can be effortlessly removed increasing opportunities for theft and tampering of the item. In order to improve the theft and tamper resistance of the packages, blister card packages are available which are composed entirely of heavy gauge plastic. Such packages are commonly used for consumer products, such as compact discs, computer devices and peripherals, household electronics, etc. These heavy gauge plastic blisters are extremely inconvenient because they usually require tools, such as knives or scissors, and a large amount of physical strength to open the blister and access the product. In addition, these heavy gauge plastic blisters cannot be directly printed on, which makes them less attractive and offers less marketing potential for vendors.

There are various techniques which can currently be employed to produce paperboards which are tear resistant or tear proof. The existing technology in the field consists of paperboard sheets which have a plastic material applied onto one side to produce a tear resistant material. The plastic material is extruded or laminated onto the sheet of paperboard. It is the laminate material, not the paperboard, which provides the resistance to tearing. However, such tear-proof paperboard often exhibits small nicks or cuts in the edge of the paperboard due to manufacturing, transport, and handling. These nicks and cuts often become a starting point for a tear, and depending on the material of the laminate, once a tear is started it can be easily continued. While such tear-proof paperboard technology can improve the theft resistance of blister card packages, they are still prone to theft and product tampering. In addition, the effectiveness of the tear resistance is diminished because a small tear or nick in the edge of a sheet can lead to the total failure of the tear-resistant material due to the propagation of the tear.

By way of example, the general state of the art of blister card packages is defined by Compere U.S. Pat. No. 3,809,221 (hereinafter referred to as "Compere"), Davie, Jr. et al. U.S. Pat. No. 4,125,190 (hereinafter referred to as "Davie"), Dlugosz U.S. Pat. No. 4,506,789 (hereinafter referred to as "Dlugosz"), Intini U.S. Pat. No. 4,537,312 (hereinafter referred to as "the Intini '312 patent"), Intini U.S. Pat. No. 4,988,004 (hereinafter referred to as "the Intini '004 patent"), Wharton et al. U.S. Pat. No. 5,172,812 (hereinafter referred to as "Wharton"), Bitner et al. U.S. Pat. No. 5,310,060 (hereinafter referred to as "Bitner"), Sowden U.S. Pat. No. 5,325,968 (hereinafter referred to as "Sowden"), Price U.S. Pat. No. 5,339,960 (hereinafter referred to as "Price"), Matthews et al. U.S. Pat. No. 5,469,968 (hereinafter referred to as "Matthews"), Leblong U.S. Pat. No. 5,758,774 (hereinafter referred to as "Leblong"), Vasquez et al. U.S. Pat. No. 5,775,505 (hereinafter referred to as "Vasquez"), Dressel et al. U.S. Pat. No. 5,785,180 (hereinafter referred to as "Dressel"), Plezia et al. U.S. Pat. No. 5,862,915 (hereinafter referred to as "Plezia"), Faughey et al. U.S. Pat. No. 5,878,888 (hereinafter referred to as "the Faughey '888 patent"), Faughey et al. U.S. Pat. No. 5,894,930 (hereinafter referred to as "the Faughey '930 patent"), Godfrey et al. U.S. Pat. No. 5,927,500 (hereinafter referred to as "Godfrey"), Ray et al. U.S. Pat. No. 5,944,191 (hereinafter referred to as "Ray"), Gartland U.S. Pat. No. 6,161,699 (hereinafter referred to as "Gartland"), Danville U.S. Pat. No. 6,338,407 B2 (hereinafter referred to as "Danville"), and Swartz U.S. Pat. No. 6,422,391 B1 (hereinafter referred to as "Swartz").

Compere, the Intini '312 patent, Wharton, Price, and Dressel disclose child-resistant blister card packaging having two layers covering the opening to each blister. To access the product contained within the blister, the user first peels an outer non-frangible layer, such as stiff paper, to expose an underlying frangible layer, such as thin foil. The underlying frangible layer comprises a material that allows the user to push the product contained within the blister through the frangible layer. This type of packaging is referred to as peel-push.

Many problems exist with peel-push blister card packaging. One such problem is the difficulty involved with grasping the outer layer so that it may be peeled. Since many outer layers are difficult to grasp, users tend to bend the overall packaging or use sharp objects to remove the outer layer. This results in damage to the packaging or to the products themselves. In particular, some of these outer layers are so difficult to grasp that senior citizens or other adults suffering from diminished physical abilities or poor eyesight may not be able to access the blister product without assistance. Also, the damage to the packaging reduces or frequently eliminates its child resistance.

Another problem with peel-push packaging is evident in blister packages containing multiple products or applications. In these packages, even if the user is able to grasp the outer layer, the user often removes too much of the outer layer, thereby accessing adjacent products. Therefore, the frangible layer of other adjacent products that the user does not intend to remove is exposed. Again, this problem causes the child resistance of the adjacent product to be reduced or totally eliminated. Furthermore, the blister card packaging does not have any means of reducing theft or product tampering.

Davie also discloses peel-push blister card packaging. However, to remove the content of the blister as disclosed in Davie, the user peels away a tear strip that exposes the frangible foil backings of an entire row of blisters. After the tear strip is removed, the user may push the content of any blister in the row through its respective foil backing. The blister card packaging disclosed in Davie suffers the same limitations as other peel-push packaging. Namely, the outer layer is difficult to grasp prior to peeling. In addition, the Davie product is actually designed to expose the frangible layer of products that are not ready to be removed. This aspect obviously diminishes the child resistant capabilities of the unopened package. Also, the Davie product contains no means to deter theft or product tampering.

Dlugosz also discloses a peel-push blister card package; however, Dlugosz discloses a method that requires the user to first bend the package. The blister card package disclosed in Dlugosz comprises a paperboard sheet folded to create two adjacent paperboard sheets. The blisters are inserted between the two adjacent paperboard sheets and contain a frangible backing through which the user may push the content of the blister. To expose the frangible backing, the user removes a tear strip located on one of the paperboard sheets. The user grasps the tear strip by bending the edge of the paperboard to access a leading tab, which assists in the removal of the tear strip. Although Dlugosz discloses a better method of grasping the tear strip, Dlugosz still requires the bending of the packaging. Also, Dlugosz does not disclose a method that prevents the user from tearing more of the backing than necessary to expose the frangible layer of the desired product. Finally, the tear strip may still be difficult to grasp for senior citizens or other adults suffering from diminished physical abilities. Furthermore, Dlugosz does not disclose any means for reducing theft or product tampering.

Similar to Dlugosz, the Intini '004 patent discloses a blister card package that requires the user to perform a "bend-peel-push" method to remove the content. First, the user bends the entire blister card package to expose a pull-tab. Then, the pull-tab may be used to peel away the outer layer of the card such that only the frangible layer remains. The content of the blister may then be pushed through the frangible layer. Although the Intini '004 patent discloses a better method of grasping the outer non-frangible layer, the Intini '004 patent still requires the user to bend the packaging. This may be difficult for frail adults, especially those suffering from an ailment such as arthritis. Furthermore, because the Intini '004 patent requires both foil and paper frangible layers, it is difficult to push the product through the two frangible layers. Furthermore, seniors have a more difficult time pressing products through the thicker frangible layers. Again, the product does not have any theft resistance means.

Bitner discloses a blister card package that requires a user to break a T-shaped perforation to access a corner of a non-frangible layer. The non-frangible layer may then be peeled away to expose the frangible layer. Subsequently, the user may push the content of the blister through the frangible layer. Although the additional layer containing the T-shaped perforation may provide a higher child resistance rating, the additional layer adds another level of complexity for those users who suffer from diminished physical abilities or poor eyesight. Also, Bitner does not disclose any theft resistance means for the blister card package.

Sowden discloses a blister card package that requires the user to perform multiple steps to remove the content of the blister. Initially, the user must remove a single blister from a solid form blister. Next, the user peels a first strip from the single blister. Once the first peelable strip is removed, a depression is exposed that allows the user to peel away the backing of the blister, thereby gaining access to the content of the blister. Similar to the packaging disclosed in Bitner, although the additional complexity required to access the content of the blister might achieve a higher child resistance rating, the additional complexity also makes the content of the blister less accessible to those users who suffer from diminished physical abilities or poor eyesight. Also, the Sowden product does not have any means to deter theft or product tampering.

Matthews discloses a blister card packaging comprising three distinct layers. The first, innermost layer is frangible, and the second and third outer layers are non-frangible. The second and third layers are perforated in two distinct patterns. Therefore, the user initially removes the third (outermost) layer according to its perforation pattern. Then, the second layer is removed according to its distinct perforation pattern. Finally, the content can be pushed through the innermost frangible layer. The packaging disclosed in Matthews suffers from the same limitations as the aforementioned packaging containing two distinct layers. Namely, there is an additional level of complexity required to access the product, and the possibility exists for the user to tear more of the backing than required. As a result, the child resistant properties of the packaging of the remaining products are reduced. However, these limitations are magnified by the addition of a third layer, i.e., the outermost non-frangible layer. Furthermore, the blister card packaging does not have any means of reducing theft or product tampering.

Vasquez discloses a blister card package that requires a user to remove an individual blister from a solid-form blister via perforations in the non-frangible layer. Once the individual blister has been isolated from the solid form blister, a pull-tab is exposed on the corner of the backing of the individual blister. The user then pulls the pull-tab to peel away the backing and access the content of the blister. Again, the Vasquez packaging requires multiple, intricate steps that will be difficult to perform by users suffering from diminished physical abilities or poor eyesight. Also, the Vasquez product does not have any means to deter theft or product tampering.

Leblong discloses a blister card package that requires the user to tear away two strips before accessing the content of a blister. The first strip is formed on the edge of a solid-form blister. Once the first strip is torn away, multiple pull-tabs form a series of secondary strips are exposed. The user may then pull away an individual secondary strip by pulling the respective pull-tab, thereby exposing a frangible layer covering a row of blisters. Thereafter, similar to Davie, the content of any blister in the row may be removed by pushing the content of the blister through the frangible layer, which reduces the package's child resistance. Furthermore, Leblong does not disclose any means for reducing theft or product tampering.

Plezia, the Faughey '888 patent, the Faughey '930 patent, and Ray disclose blister card packages that require the user to press on a specified area of the blister card package to create a pull tab. Thereafter, the pull-tab may be pulled to remove the backing from the blister and expose the blister content. However, none of these patents disclose a method that prevents the user from removing more of the backing than that which covers the intended blister or blisters to be dispensed. In addition, although the pull-tab facilitates removal of the blister backing for an adult, the pull-tab also reduces the package's child resistance by facilitating removal of the blister backing by a child. Again, the product does not have any theft resistance qualities.

Godfrey discloses a folded blister card package that encloses a blister, blister strip, or solid-form blister. The side of the folded blister card that faces the blister backings comprises a series of oval perforations. To eject the content of a blister, the user simply presses the top of the blister forcing the content of the blister through the foil backing and the respective oval perforation, causing a hole to form in the blister card packaging through which the content of the blister may pass. If the rigidity of the perforated ovals is low, the packaging disclosed in Godfrey allows a child to have easy access to the content of the blister. In contrast, if the rigidity of the perforated ovals is high, the Godfrey packaging impedes access to the content of the blister for adults having impaired physical abilities. Also, Godfrey does not disclose any theft resistance means for the blister card package.

Similar to Godfrey, Gartland also discloses a blister card package comprising a series of perforated ovals; however, Gartland discloses a layer of plastic biaxial film that covers the perforated ovals. To remove the perforated ovals, the user must first peel the plastic biaxial film from the ovals. The perforated ovals can then be removed such that the foil backing of the blisters are exposed. The user then pushes on an individual blister to force the blister content through the blister backing. These three steps can be very difficult for a senior citizen or other adult with impaired physical abilities. Such individuals may resort to sharp objects for removal of any of the aforementioned layers, which is likely to damage the packaging or product contained within the packaging. Also, the Gartland product does not have any means to deter theft or product tampering.

Danville discloses blister card packaging that also requires the user to perform a series of steps to access the blisters' content. First, the user must remove a group of blisters by pushing the group through a perforated section of the blister card package. Once the blister group is removed from the blister card package, a second perforation is exposed. The user then accesses the second perforation to grab and tear the packaging in the area adjacent to the desired blister. Along the tear, there is an area wherein the portion of the backing being torn and the underlying backing are not adhered together. At this location, the layers may be easily separated allowing the innermost backing to be easily peeled away from the blister. Whereas the lack of adhesion between the outer and inner layers of the backing facilitates removal of the backing, the multiple peels required to remove the blister's content renders the Danville packaging difficult for adults having impaired physical abilities. Furthermore, the blister card packaging does not have any means of reducing theft or product tampering.

Finally, Swartz provides a blister card package that requires the user to tear the blister card package in two directions. Prior to tearing the blister card package, the user must remove a blister segment via a perforated section of the blister card package. Each blister segment comprises two lines cut in the blister segment backing such that the two lines merge on one side of the backing and are separated on the other side of the backing. Therefore, by pushing between these two lines at the point where the two lines merge, the user may create a pull-tab that may be used to begin tearing the segment backing. Finally, to access the content of the desired blister, the user continues to tear the previously torn backing in the direction of the desired blister. The blister card packaging disclosed in Swartz does not contain a method of preventing more than the desired backing from being torn. Additionally, the pressure exerted on the packaging to form the pull-tab may damage the packaging. Also, the Swartz product does not have any means to deter theft or product tampering.

Thus, there is a clear need for retail and consumer packaging that incorporates means for reducing theft, product tampering, and product degradation when the packaging is displayed for customers to handle at retail locations. In addition, a clear need exists for an improved form of packaging that is also child-resistant and senior-friendly. There is also a clear need for a tear resistant blister card packaging that contains two types of cuts, which allows for the content of the individual blister to be cleanly pushed through a non-frangible layer without bending the entire blister card packaging or disrupting adjacent blisters.

SUMMARY OF THE INVENTION

One object of the present invention is to provide an improved theft-resistant blister card package particularly suited for the distribution of retail and consumer products. The blister card package of the present invention is designed to increase the level of theft and tamper resistance by preventing tears in the paperboard which could result in failure of the package and improper dispensement of the product. In addition, the blister card package halts existing tears to avoid further damage to the blister package. Additionally, the blister card package of the present invention allows an item to be removed cleanly from its individual blister without damage to the blister card package or the item contained in the blister card package. Furthermore, each item may be removed without degrading the child resistance of the blister card packaging enclosing the remaining items, if any.

It is another object of the present invention to provide other enhanced retail and consumer product packaging systems and methods in addition to blister card packaging that incorporate the same theft-resistant, tear-resistant, and senior-friendly qualities. These forms of packaging may similarly reduce product tampering and ensure product integrity.

The blister card package of the present invention is used to encase an individual blister, blister strip, or solid-form blister as described above. After one or more of the blister segments are inserted into the blister card package, the blister card package is sealed around the blister segment, typically via the application of pressure and heat. The blister card package and contained blister segment(s) are then distributed to individual users. The user accesses the content of the individual blister by, for example, cutting portions of the package, tearing along pre-defined perforations, using a push-peel-push method or pushing the contents of the individual blister through the non-frangible layer of the package, as described in the instructions printed on the paperboard of the blister card package, or other like methods of access.

For example, in the push-pull-push method, the user pushes a specially-marked, color-coded target area with an object, such as a pen, fingernail or a specially designed tool, which may be provided with the blister card package, to form a pull tab. The use of a tool to create a pull-tab minimizes the physical strength required by the user. It has a wide base for holding the tool and a small end for pushing the target area on the blister card. The color-coded target area facilitates use for those suffering from diminished eyesight. Additionally, pushing the tool through a specially marked target area that is separate from the individual blister, as compared to bending the blister card package or pushing the individual blister, prevents damage to the blister card package and its contents and also maintains the child-resistance of the packaging.

Each individual blister has an associated target area and die-cut portal or blister panel. Pushing the specially marked target area causes the die-cut portal in the paperboard backing (i.e., the backing that reinforces the foil backing of the blister segment) to break away from the remainder of the paperboard backing. The pushed portion of the die-cut portal forms a tab that may be used to peel the remainder of the die-cut portal from the paperboard backing, thereby exposing the frangible layer covering the individual blister opening. Due to the unique manufacturing method of the blister card package the die-cut portal is removed completely and easily without removing any of the paperboard surrounding the die-cut portal, thereby maintaining the child resistance rating and the structural integrity of the blister card package. Finally, the content of the designated individual blister may be pushed through the frangible backing.

In another example, the user may apply pressure directly on the blister, which essentially pushes the contents of the blister through a non-frangible layer containing two types of cuts. These two types of cuts consist of a score-cut and a perforated cut. The design of the non-frangible layer also known as the rear card is novel because it contains a perforated cut, which completely penetrates the rear card, and a score-cut, which only partially penetrates the rear card. This design of the rear card is what allows a user to cleanly push the contents of the blister safely through the non-frangible rear card without accidentally releasing the contents of the remaining blisters or bending and damaging the entire blister card package. Additionally, since the backing of the blister card package (rear card) is resilient and sturdy the product remains both theft-resistant and child-resistant while maintaining its senior-friendly characteristics. What is important to notice is that this method does not require a user to push a specially-marked target area and therefore a pull-tab is no longer required as previously discussed in the push-pull-push method.

To manufacture the blister card of the present invention, a single sheet or multiple sheets of a material such as paperboard, cardboard, or another similar material may be used. For exemplary purposes, manufacturing with a single sheet of paperboard is described.

First, the paperboard sheet is cut. The cut of the sheet is based partly on the specifications of the items to be packaged, i.e., the retail item pre-packaged in 4.times.4 solid form blisters, and partly on the blister card manufacturer's method of achieving child-resistant, senior-friendly standards and theft resistance. In the preferred embodiment, a laminated tear-resistant film is applied to the back side of the paperboard, opposite the finished/smooth surface for printing. Preferably, the tear-resistant layer is polyester, but the layer could comprise any similar tear-resistant layer of material, such as any variety of polymer or plastic.

Although a tear-resistant layer is used to prevent the starting points of a tear, any break, cut, nick, or deformity in the edge of the paperboard can effect the initiation and continuation of a tear. Specifically, during manufacturing of a child resistant heat seal blister card, it is likely that some portion of the outer edge of the blister card may develop areas of degradation, including bends, nicks, or breaks, which can allow for the initiation of a tear. The tear may eventually propagate to the product-containing blister and eventually to the product itself.

The blister card package of the present invention is designed to halt the propagation of a tear in the tear-resistant material or cardboard backing if it should occur. This is accomplished by applying a clean and unbroken "tear-stop" cut to the paperboard which fully penetrates the thickness of the tear-resistant laminate film but does not fully penetrate through the paperboard. This eliminates the possibility of tear initiation points and propagation beyond the tear-stop cut. In the preferred embodiment, the tear-stop cut is added to the paperboard approximately ¼ inch to ½ inch inside of all of the cut edges of the card. However, the tear-stop cut may be placed closer or farther from the outside edge as desired. Therefore, a tear, if it is initiated from the outer edge of the sealed card, is prevented from running through the tear-stop cut.

Alternatively, a tear-stop cut may also be placed around each of the individual blister targets, or any convenient location that would halt the continuation of a tear in the paperboard. In the preferred embodiment, the tear-stop cut is applied to all perimeters of the card, maintaining the tear resistance of the laminated paperboard. Thus, it is difficult to access the product by tearing the heat seal child-resistant blister card from the edges of the card.

The child-resistant and senior-friendly attributes of the present invention are created by one distinct cut per blister on the front card and a unique bi-level cut on the rear card. The front card is the portion of the paperboard sheet that will be placed on top of the blisters and the rear card is the portion of the paperboard sheet placed behind the foil backing of the blister segment. The distinct cut in every individual blister on the front card provides an aperture through which the individual blister is placed. The bi-level cut on the rear card includes one perforated cut, which completely penetrates the paperboard, and one cut-score, which partially penetrates the paperboard. In the preferred embodiment of the present invention, the perforated cut comprises an oval that surrounds the blister opening, and is associated with the blister. The cut-score is also oval, but slightly smaller than the perforated cut.

The cut score is located on the interior of the blister card package to facilitate a clean tear of the die-cut portal, which is attached to the rear card by the perforated cut. Therefore, the cut score does not facilitate a clean tear if the user presses from the back of the package or does not follow instructions. For example, it will be very difficult for a child playing with the package to tear the portal from the exterior of the package or an individual to remove the content of the package in an attempt to steal the contents without using a tool to damage the die-cut portal or using a device to cut through the blister pack. Additionally, the length and size of the cuts and landings (i.e., the intact portions between the cuts that form the die-cut portal) can be varied to regulate the difficulty with which the die-cut portal is removed.

It is an object of the present invention to provide cost effective packaging that is difficult for a person to manipulate for the purpose of theft or product tampering.

It is also an object of the present invention to provide improved blister card packaging that is difficult to open by means of tampering with the packaging.

Furthermore, it is an object of the present invention to prevent a tear in the packaging material of a consumer product and to halt the propagation of a tear if one should occur.

Additionally, it is an object of the present invention to provide packaging that is easily accessible to competent adults and senior citizens, including those with impaired physical abilities.

It is also an object of the present invention to provide blister packaging that is easily and inexpensively manufactured.

Further, it is an object of the present invention to provide blister card packaging that allows an individual blister's contents to be easily and cleanly removed without damage to the blister card package, the blister contents, or the blister backings.

In addition, it is an object of the present invention to provide blister card packaging that allows text, images, patterns, designs, and other marketing material to be printed on the packaging.

It is yet another object of the present invention to provide blister card packaging that allows instructions to be printed on the packaging.

Additionally, it is an object of the present invention to provide packaging other than blister packaging that incorporates tear-resistant material in the packaging.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment, along with some alternative embodiments, set forth in the illustrations of the accompanying drawings. Although the illustrated embodiments are merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF THE INVENTION

Detailed illustrative embodiments of the present invention are disclosed herein. However, techniques, systems and operating structures in accordance with the present invention may be embodied in a wide variety of forms and modes, some of which may be quite different from those in the disclosed embodiments. Consequently, the specific structural and functional details disclosed herein are merely representative, yet in that regard, they are deemed to afford the best embodiments for purposes of disclosure and to provide a basis for the claims herein which define the scope of the present invention. The following presents a detailed description of a preferred embodiment (as well as some alternative embodiments) of the present invention.

Figure 1A:
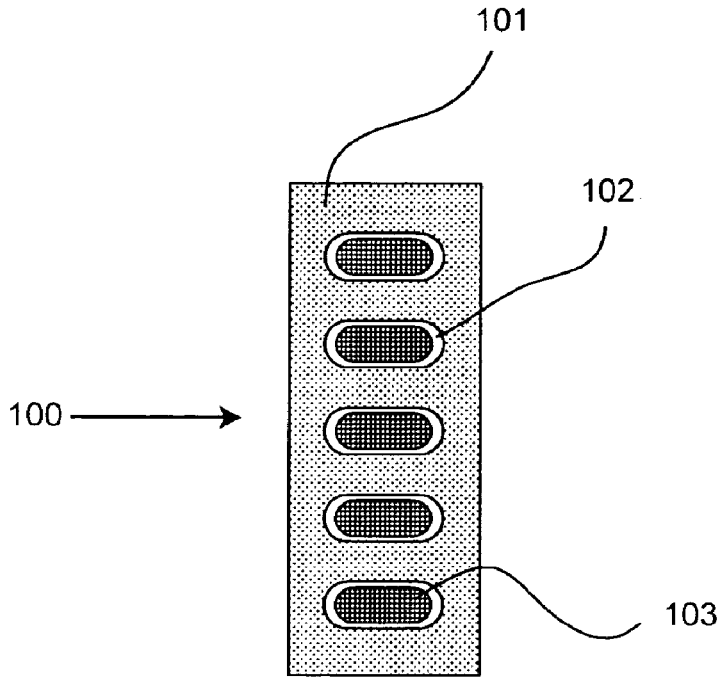
FIG. 1A depicts a front schematic view of a single strip blister card in accordance with the preferred embodiment of the present invention.

FIG. 1A depicts a front schematic view of a blister card in accordance with the preferred embodiment of the present invention. Blister card 100 comprises base 101, which is preferably thermoformed from a flexible, semi-rigid plastic. However, base 101 may be constructed from various other materials including, for example, injected mold plastics, thick foil, polyvinyl chloride (PVC), polyvinyl dichloride (PVdC), Aclar, polypropylene (PP), etc. Blister 102 of blister card 100 is a bubble-type portion that is typically manufactured of the same material as base 101. Blister 102 protrudes from base 101 forming a cavity wherein a product may be stored. FIG. 1A illustrates blister 102 containing product 103. As depicted, product 103 is of an elongated oval shape, which is commonly associated with a pharmaceutical-type medicine dosage. However, this type of product is shown for exemplary purposes only and other types of retail products may be utilized in accordance with the present invention. For example, product 103 may include such items as machinery parts, tools, hardware, personal care products, consumer electronics, toy cars, sewing kits, or any other product that may be stored within a blister-type enclosure. Also, the present invention may utilize cold-form blisters, or blisters that are formed from two sheets of foil such that a first sheet forms one or more blisters and a second sheet forms the blister seals. In accordance with the present invention, cold-form blister foils are typically made from layers of various materials, including aluminum, biaxally orientated polyamide (OPA), and PVC, but any suitable materials may be used.

Figure 1B:
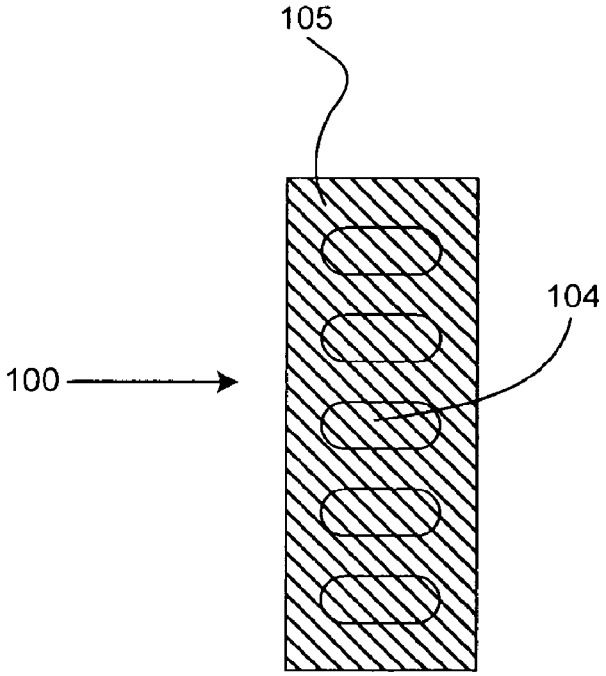
FIG. 1B depicts a rear schematic view of the single strip blister card of FIG. 1A in accordance with the preferred embodiment of the present invention.

Turning to FIG. 1B, depicted is a rear schematic view of blister card 100, which illustrates backing 105. Portions of backing 105 act as seal 104 for sealing the openings of blister 102. Backing 105 is preferably constructed from aluminum foil. However, other types of foil, films, or other materials such as paper and plastic may be used. Additionally, backing 105 may comprise perforations or cut-scores surrounding portions of the backing. These portions may overlap, follow, or coincide with the perimeter of the blister opening, i.e., seal 104. The perforations or cut-scores may be designed to assist the user in penetrating the portion of backing 105 that acts as seal 104.

Figure 1C:
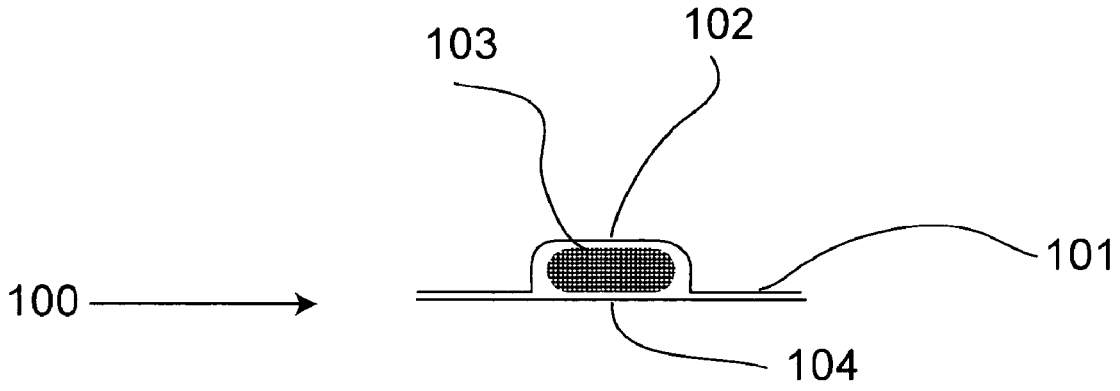
FIG. 1C depicts a side cross-sectional view of the single strip blister card of FIG. 1A in accordance with the preferred embodiment of the present invention.

FIG. 1C depicts a side view of blister card 100. A user can easily remove product 103 from blister 102 by pushing downward (with respect to the horizontal plane) on blister 102 such that product 103 ruptures or displaces seal 104. Preferably, seal 104 of blister card 100 is frangible to prevent damage to product 103 or other content of blister 102 when the content is pushed through the frangible layer. Blister 102 is preferably constructed from a tear and puncture resistant, durable, flexible, semi-rigid material, thus allowing the user to push on blister 102 forcing product 103 through seal 104 while preventing breakage of product 103. Further, blister 102 may be formed as an indentation in base 101 or may be constructed from a different material that is adhered to base 101.

Figure 2A:
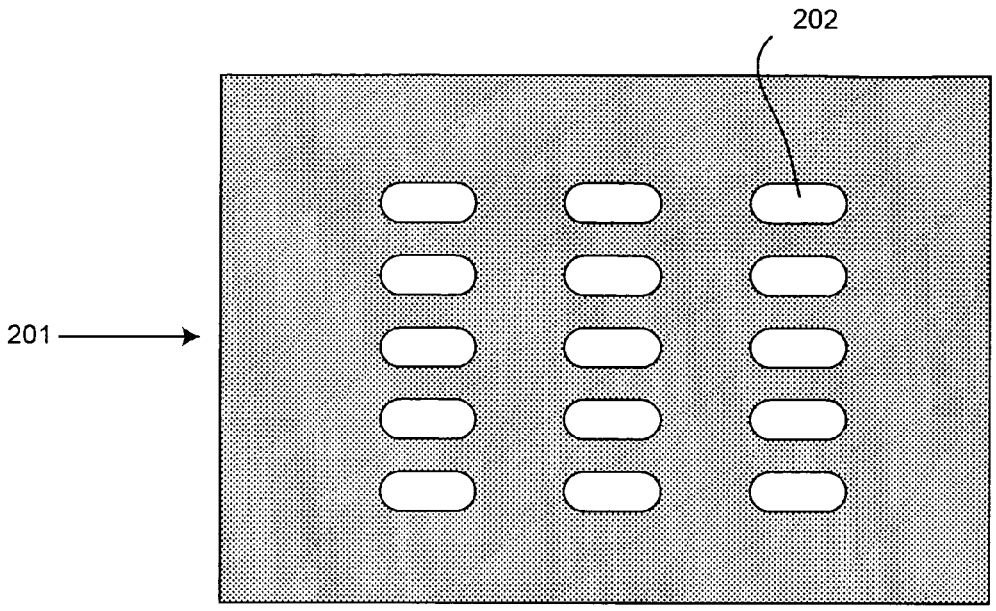
FIG. 2A depicts a front schematic view of the front card of a multi-strip blister card package in accordance with the preferred embodiment of the present invention.
Figure 2B:
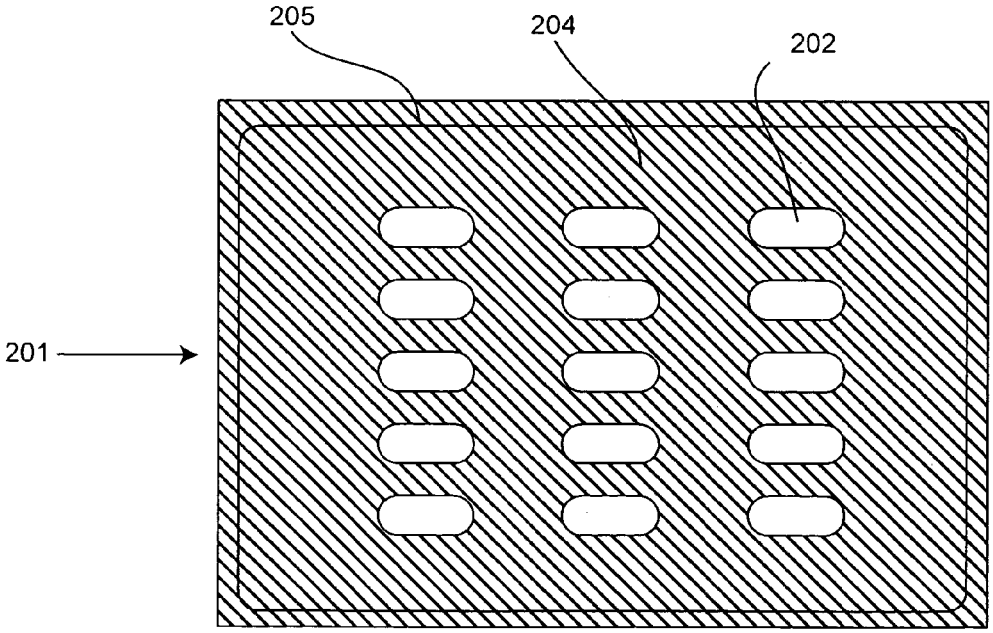
FIG. 2B depicts a rear schematic view of the front card of the multi-strip blister card package in accordance with the preferred embodiment of the present invention.
Figure 2C:
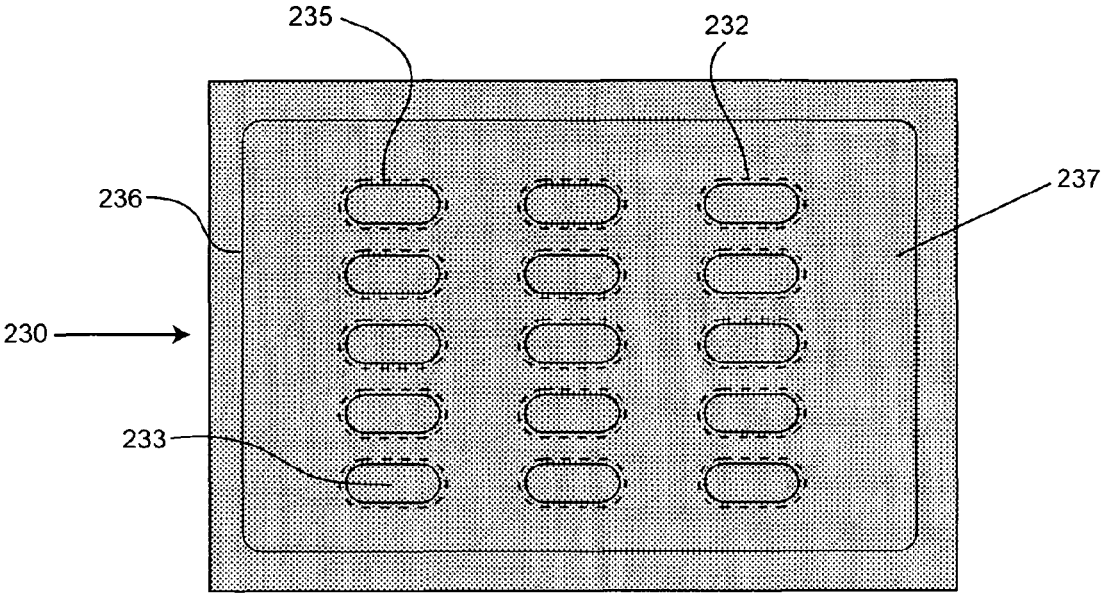
FIG. 2C depicts a front schematic view of the rear card of the multi-strip blister card package in accordance with the preferred embodiment of the present invention.
Figure 2D:
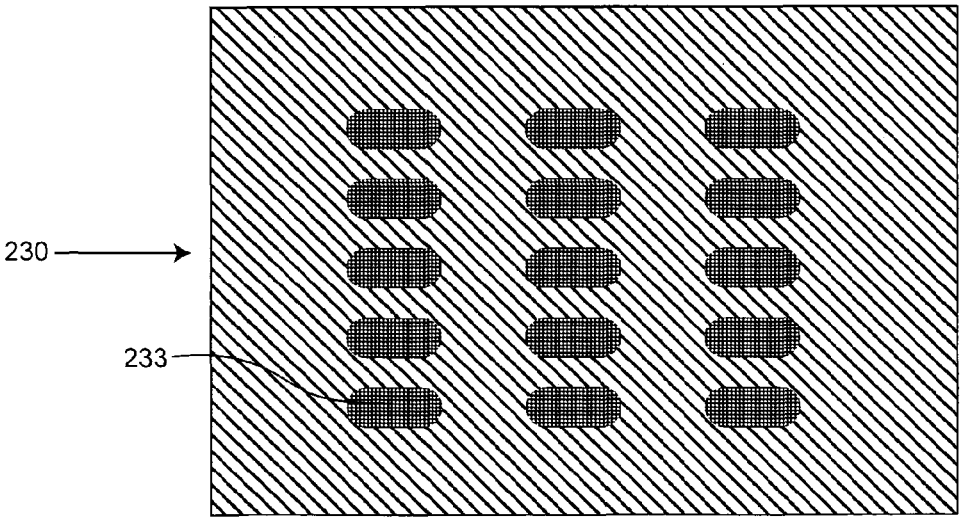
FIG. 2D depicts a rear schematic view of the rear card of the multi-strip blister card package in accordance with the preferred embodiment of the present invention.

As shown in FIGS. 2A, 2B, 2C, and 2D, the blister card package of the preferred embodiment of the present invention is constructed from front card 201 (FIGS. 2A and 2B) and rear card 230 (FIGS. 2C and 2D). Front card 201 of FIG. 2A comprises at least one oval aperture 202. Oval aperture 202 is adapted to fit a blister, which is placed through oval aperture 202.

In the preferred embodiment of the present invention, the paperboard used to create front card 201 has one side that is laminated and pre-coated with a heat-activated adhesive. Purchasing paperboard with pre-applied adhesive reduces the cost of manufacturing. The paperboard of front card 201 is configured such that the rear of front card 201 is coated with the adhesive. Although the preferred embodiment of the present invention uses an adhesive activated by heat, other adhesives including an adhesive activated by some other means (such as pressure) may also be used. Alternatively, front card 201 can be fabricated without adhesive, whereupon adhesive is applied during the assembly process, or a method other than adhesion may be utilized to assemble the blister card package (e.g., crimping, pressure sealing, fusion, fastening, etc.).

For exemplary purposes, front card 201 comprises oval aperture 202. However, any configuration or any number of apertures is contemplated without departing from the spirit of the present invention. In fact, the present invention may utilize irregular, custom, or generic arrangements. Additionally, the design employed by the present invention can accommodate a large volume of oval apertures 202 (or any other shape of aperture) in many various arrangements, thereby making the present invention suitable for various retail, consumer and pharmaceutical products.

An exposed rear view of front card 201 is depicted in FIG. 2B. In the preferred embodiment, the rear side of front card 201 is laminated with a tear resistant plastic film 204, such as polyester. However, any type of tear-resistant material such as polyethylene or polypropylene may be used to create a film. Alternatively, either side of the paperboard may be completely or partially laminated. The laminated material increases the level of theft resistance by making the paperboard highly resistant to tears. Furthermore, the tear resistance of laminated paperboard can be significantly increased by the addition of a "tear-stop" cut. The tear-stop is a cut applied to the laminated side of the tear-resistant paperboard. A clean, unbroken cut approximately one-quarter inch to one-half inch inside all of the perimeter edges of the card forms tear-stop cut 205. Of course, it is contemplated that the tear-stop may be placed at any point along the paperboard while still performing the functionality of stopping the propagation of side tears. The tear-stop cut fully penetrates the thickness of tear resistant film 204 but does not fully penetrate through the paperboard. Therefore, if a tear is initiated from the outer edge of the sealed card, the tear will not readily continue and run through or beyond tear-stop cut 205. As shown, tear-stop cut 205 may be applied to all perimeters of the card. The tear-stop cut may be placed at any distance from the outer edge of the paperboard and in any arrangement.

A laminated paperboard is highly tear resistant where there are no nicks or cuts along the edge of the paperboard. However, it is very difficult to manufacture a product made from the laminated material without creating small imperfections along the edge of the product. An object of this invention is to create a second edge, a new tear-stop edge, with fewer or no nicks or cuts so that the propagation of tears is eliminated. It is also contemplated that multiple tear-stops can be created within the same product. This layering of tear-stops would further increase the tear resistance of the card.

If a person were to attempt to tear the laminated paperboard from the edge and was successful in beginning a tear, they would quickly arrive at the tear-stop of the laminate and be prevented from tearing across, through, or beyond the remainder of the package. This method of increasing the tear resistance of paperboard materials will be important for improving the child resistance, tamper resistance, and theft resistance of retail products. When an improved tear-resistant paperboard is used in conjunction with a blister card package or other retail package for a consumer product, the ability to easily pilfer the product from the package is greatly diminished. For example, a thief in a retail location can easily tear a 2 inch cubic cardboard box and obtain the small item inside in an attempt to take the small item. To remedy this, the small item may be packaged in a large (e.g., a 12 inch) reinforced paperboard blister pack utilizing at least one tear-cut. A thief capable of creating a first tear may be further defeated by the tear-cut, which prevents the tear from proceeding. To overcome the tear-cut, the thief must expend time and effort to create another new tear. Although rigid plastic packaging known in the art acts as a deterrent in this manner, the present invention allows for the novel use of the tear-cut to further enhance the tear resistance. In addition, this method still provides for a surface that the retailer can utilize to market the product (e.g., a retailer can market the product by printing graphics on the paperboard blister that could not be easily printed on the rigid plastic surfaces commonly utilized).

Front and rear views of rear card 230 are illustrated in FIGS. 2C and 2D, respectively. For the preferred embodiment of the present invention, rear card 230 is fabricated from paperboard purchased with a heat-activated adhesive pre-applied to one side of the paperboard, again, to reduce the cost of manufacturing. The paperboard of rear card 230 is positioned such that the front of rear card 230 contains adhesive and the rear of rear card 230 does not. As described above for front card 230, an adhesive activated by some means other than heat may also be used. Alternatively, the rear card 230 can be fabricated without adhesive and adhesive may either be applied during the assembly process or a method other than adhesion may be utilized to assemble the blister card package. In the preferred embodiment, the front of rear card 230 is laminated with a tear resistant plastic film 237 comprised of polyester or other comparable polymers, such as polyethylene or polypropylene. After assembly, the front of rear card 230 will be hidden. Tear-stop cut 236 may be added to rear card 230 in the manner described with respect to front card 201. Tear-stop cut 236 is placed one-quarter inch to one-half inch from the outer edge and is only visible from the front view of rear card 230, as depicted in FIG. 2C. Thus, in this embodiment, the tear-stop cut is not exposed once the package is assembled.

Rear card 230 comprises perforated cut 232 forming blister panel 233 that can be seen from both the front and rear of rear card 230. However, cut-score 235 may only be seen from the front of rear card 230 as depicted in FIG. 2C. From the back of rear card 230, as shown in FIG. 2D, cut-score 235 may not be visible. This may help enhance the theft-resistance of the package since cut-score 235 is not readily visible to a consumer or potential thief. Cut-score 235 is shown concentrically located within perforated cut 232; however, depending on the material of rear card 230, implementing perforated cut 232 concentrically within cut-score 235 is sometimes preferable. Additionally, the same type of cut (i.e., perforated, cut-score, or tear-stop) could be used for both the inner and outer cut. It is contemplated that any combination or quantity of cut types and locations may be used without departing from the spirit of the invention.

Cut-score 235 is only visible from the front of rear card 230 because it does not penetrate the entire thickness of rear card 230. Rather, cut-score 235 only partially penetrates rear card 230. In contrast, blister panel 233 is cut throughout rear card 230 such that the blister panel 233 encircles its oval aperture 202 (FIGS. 2A and 2B) when the blister card packaging is fully assembled. The degree of perforation used to cut perforated cut 232 may be altered to vary the force necessary to remove blister panel 233.

Without cut-score 235, blister panel 233 is not likely to tear cleanly. Cut-score 235 along with perforated cut 232 effectively allow for a clean removal of blister panel 233. Without both cut-score 235 and perforated cut 232, blister panel 233 would not remove cleanly, thus resulting in tearing a blister panel belonging to a product that the user does not desire to remove at that time or possibly damaging the entire blister card package. Additionally, if blister panel 233 is not removed cleanly, blister panel 233 may separate into layers such that one layer is removed and another layer remains attached to rear card 230 or the seal. This can cause difficulties when a user attempts to push the product through the seal. A user may not have sufficient strength to break through the remaining layer of paperboard, or, if the user applies additional force, the force required may damage the product.

Although the preferred embodiment of the present invention uses some form of pre-applied adhesive during the construction of the blister card package, it is also possible to construct the blister card package of the present invention without the use of pre-applied adhesives. Instead, paperboard can be purchased without pre-applied adhesive and the adhesive can be stamped onto the paperboard with a printing press such that adhesive is not applied to the areas slightly larger than the perimeters of blister panel 233.

Figure 2E:
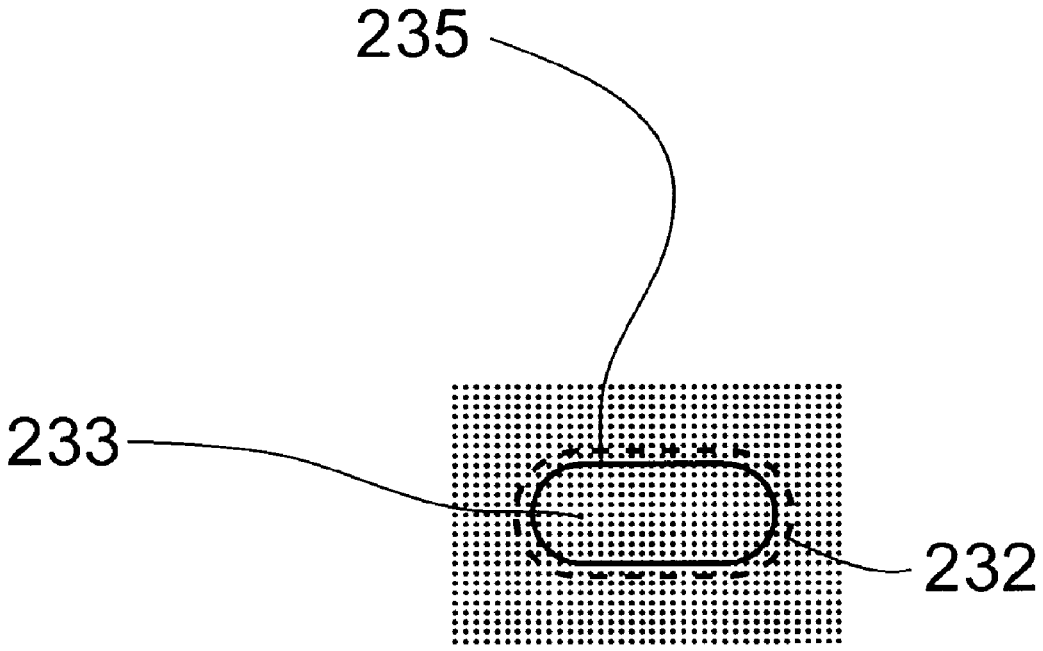
FIG. 2E depicts a magnified view of the die-cut portal, cut-score, and the perforated cut of the rear card of FIG. 2C.

In the preferred embodiment of the present invention, perforated cut 232 operates in conjunction with cut-score 235, as depicted in FIG. 2E, to ensure a clean tear of blister panel 233. After a user pushes on blister 102 either by hand or with the help from a tool, blister panel 233 is easily torn because blister panel 233 does not stick to the seal, and the tear follows the path of least resistance, i.e., along cut-score 235. Since perforated cut 232 and cut-score 235 are located internal to the blister card package and are not accessible from the exterior of the package. These two features assist in the clean tear of blister panel 233 only after blister panel 233 has been pushed either by hand or with a tool, thereby maintaining the child-resistance of the blister card package.

The perforated cut 232 and cut-score 235 of the preferred embodiment of the present invention may be die-cut. Moreover, perforated cut 232 and cut-score 235 can be manufactured in a single step utilizing a combination of special die-cut knives. A first oval-shaped blade of the knife preferably has nicks (or a square saw tooth shaped edge) such that the blade creates perforations when pressed into rear card 230. A second oval-shaped blade is preferably recessed such that it only cuts partially through rear card 230, thereby forming cut-score 235. Although cut-score 235 does not extend through rear card 230, the use of a specially manufactured bi-level die, or positioning two die cutting knives at different levels, allows the rear card to be cut in one step, thereby reducing the cost of manufacturing. Although previously described in terms of ovals or a blade having nicks, any other shape which functionally accomplishes the same purpose may be used without departing from the spirit of the present invention.

Figure 3A:
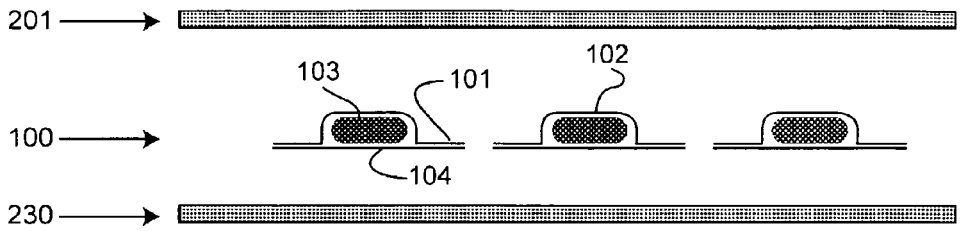
FIG. 3A depicts an exploded side view of the front card of FIG. 2A and rear card of FIG. 2C of the multi-strip blister card package in accordance with the preferred embodiment of the present invention and the blister card prior to assembly in accordance with the preferred embodiment of the present invention.

FIG. 3A depicts an exploded side view of front card 201, blister card 100, and rear card 230 prior to assembly. Blister 102 is aligned with blister panel 233 (FIG. 2C) of front card 201 and rear card 230, respectively.

Figure 3B:
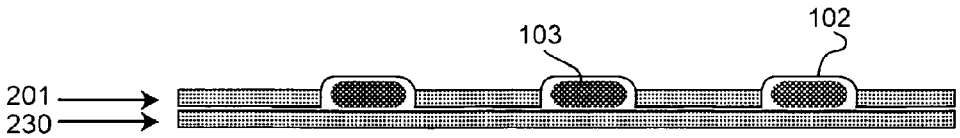
FIG. 3B depicts a side view of the assembled front card, rear card, and blister card of FIG. 3A to create a blister card package in accordance with the preferred embodiment of the present invention.

Shown in FIG. 3B is a side view of front card 201 and rear card 230 after assembly. Blister 102 protrudes through oval aperture 202 of front card 201 (FIGS. 2A and 2B) such that it may be seen and manipulated by a user. Front card 201 is juxtaposed against rear card 230 such that base 101 and seal 104 (FIG. 3A) of blister card 100 (FIG. 3A) are encased between front card 201 and rear card 230. To secure the assembly, front card 201 and rear card 230 are preferably sealed to each other via application of heat and pressure. Preferably, portions of front card 201 and rear card 230 adhere to each other between blister card 100 (FIG. 3A).

Figure 3C:
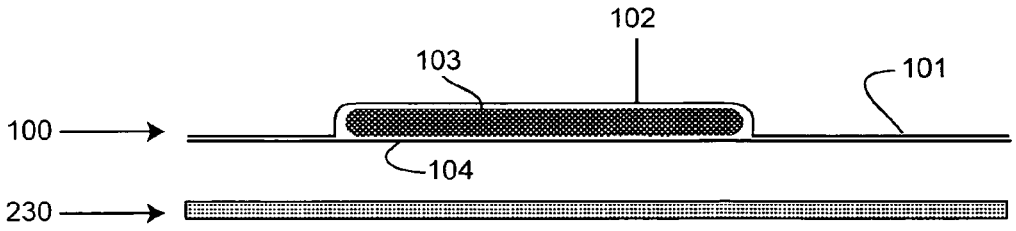
FIG. 3C depicts an exploded side view of the blister card of FIG. 1A and rear card of FIG. 2C of the multi-strip blister card package in accordance with the preferred embodiment of the present invention and the blister card prior to assembly in accordance with the preferred embodiment of the present invention.

An additional embodiment of the present invention is illustrated in FIG. 3C, which depicts an exploded side view of blister card 100, and rear card 230 prior to assembly. Blister 102 is aligned with blister panel 233 (FIG. 2C) of rear card 230.

Figure 3D:
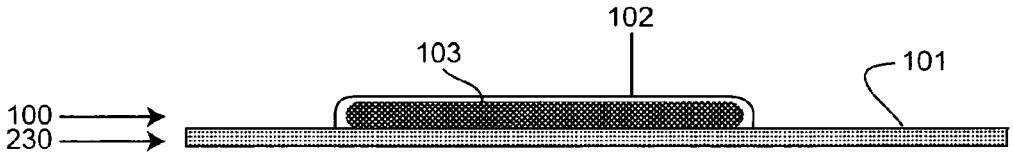
FIG. 3D depicts a side view of the assembled blister card and rear card of FIG. 3C to create a blister card package in accordance with the preferred embodiment of the present invention.

Shown in FIG. 3D is a side view of blister card 100, and rear card 230 after assembly. Blister card 100 is juxtaposed against rear card 230 such that base 101 of blister card 100 is firmly adhered to rear card 230. To secure the assembly, blister card 100 and rear card 230 are preferably sealed to each other via application of heat and pressure.

To ensure proper operability of the blister card package, seal 104 of blister card 100 (FIG. 1B) is preferably not heat sealed to panel 233 of rear card 230 (FIGS. 2C and 2D). Thus, seal 104 does not tear when panel 233 is removed. Additionally, a portion of panel 233 will not separate and remain attached to seal 104. Various manufacturing methods may be utilized to prevent adhesion of seal 104 to panel 233. One method is to avoid application of heat-activated adhesive to panel 233 or seal 104. For instance, adhesive may be applied only to front card 201 after oval aperture 202 is cut. Alternatively, the heat-activated adhesive may be applied to the entire front surface of rear card 230, and a specially designed heat-sealing plate having voids that correspond to panel 233 and seal 104 may be used to activate the adhesive only in desired areas.

Front card 201 and rear card 230 are of sufficient size to be adhered around a blister card and to ensure child-resistance and durability. Although heat sealing is used for the preferred embodiment of the present invention, various other adhesion techniques may be applied such as pressure sealing, RF sealing, dielectric sealing, ultrasonic sealing, etc. The present invention functions equally well with adhesives that do not require heat or pressure.

In an alternative embodiment, front card 201 and rear card 230 can be constructed from a single sheet of foldable paperboard. Consequently, the sheet can be folded and blister card 100 inserted therein to assemble the blister card package. Although paperboard is preferred, various other materials may be used without departing from the scope of the present invention.

Figure 4:
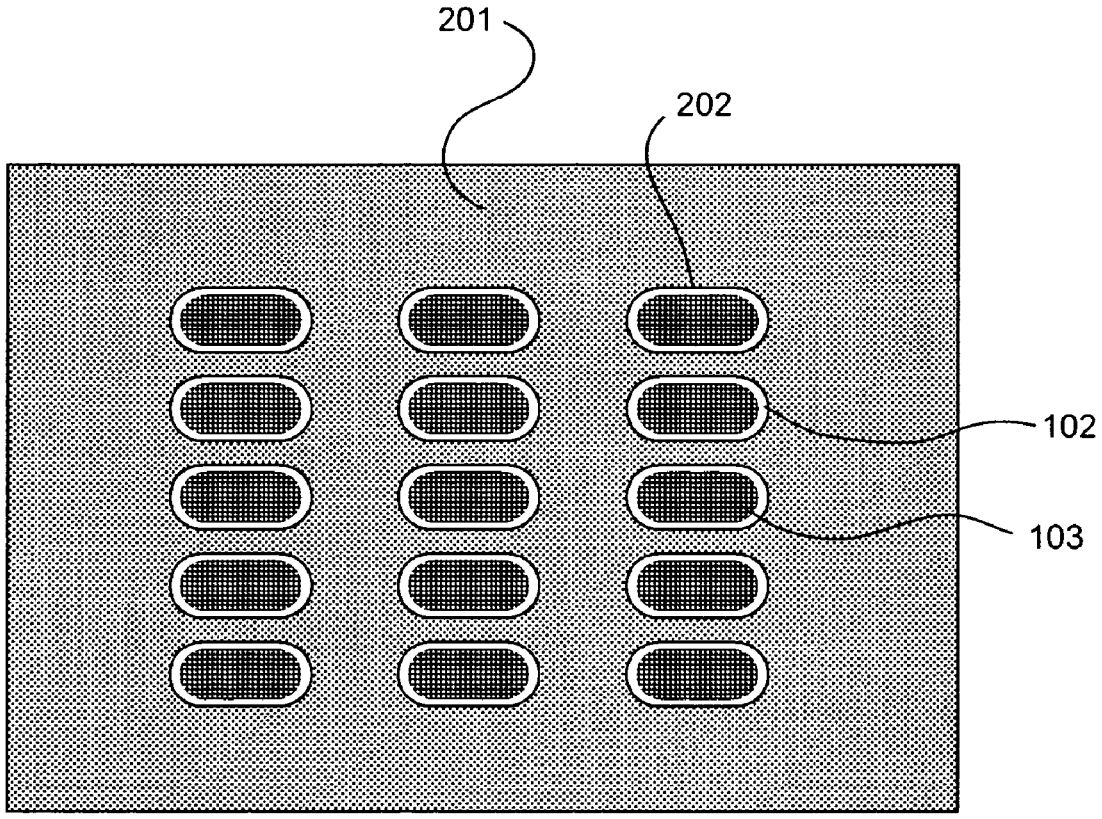
FIG. 4 depicts a front schematic view of the assembled blister card package of FIGS. 2A-3B in accordance with the preferred embodiment of the present invention.

FIG. 4 depicts a front view of the assembled blister card package illustrated in FIGS. 2A-3B. Blister 102 protrudes through oval aperture 202. The laminated sides of the paperboard and the tear-stop cuts are not visible since the rear card is adhered to the front card to form the blister card package. Further, when the contents of blister 102 are hidden or additional surface space for product marketing or product information is required by the retailer or manufacturer, content information can be printed on base 101 of blister strip 100 of FIG. 1. As illustrated by FIG. 4, the content information printed on base 101 is hidden by front card 201 or rear card 230 of FIG. 3B. Yet, the content information can be obtained by cutting the blister card package, tearing apart the blister card package, or by accessing the package through pre-defined perforations.

Figure 5:
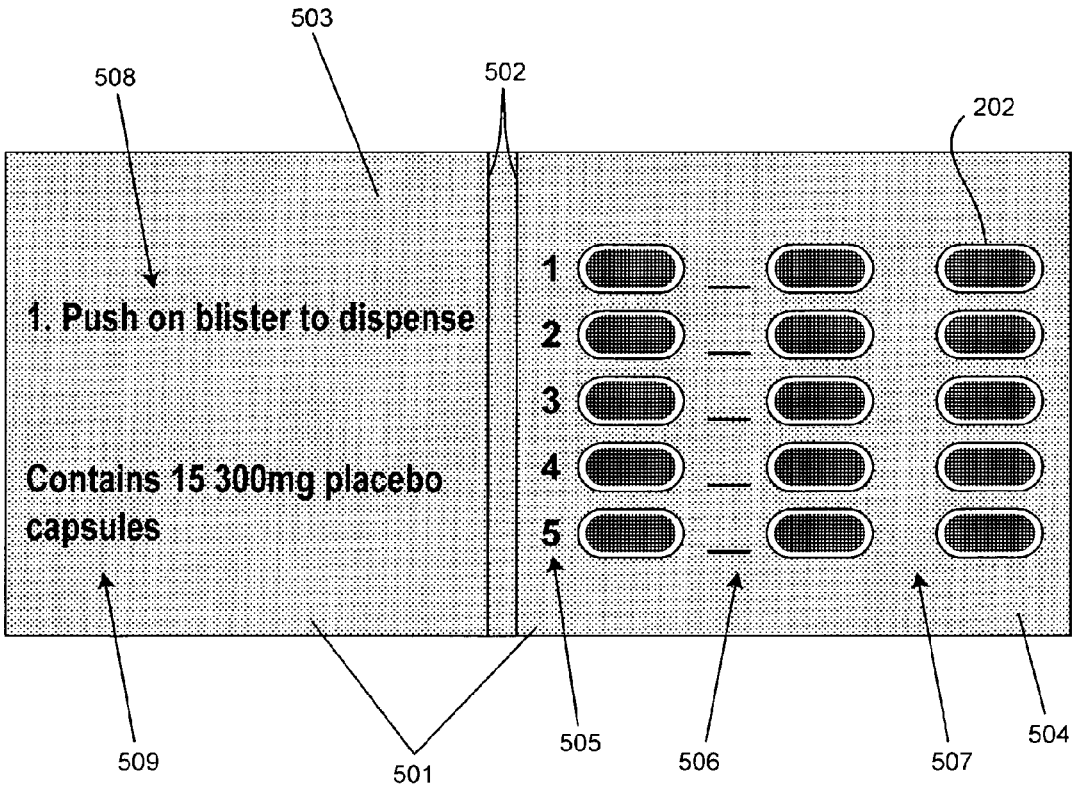
FIG. 5 depicts a front schematic view of an unfolded blister card package of the preferred embodiment of the present invention having a foldable front cover comprising printed instructions, dosage information, and content information.

The preferred embodiment of the present invention is shown in FIG. 5 with the front card 501 extended flat and unfolded in the leftward direction. The rear card 230 (FIGS. 2C and 2D) may also be extended in this direction. Fold lines 502 are implemented such that the extended section, left flap 503, easily folds over right flap 504. The folded package may resemble the front and back covers of a book or magazine.

Left flap 503 comprises printed instructions 508 reading, "1. Push on blister to dispense." Additional product information 509 may also be printed on left flap 503. Pre-printed information 505 may also be included on right flap 504 or left flap 503 to indicate dosage number, pill type, or any other relevant information. Alternatively, pre-printed lines 506 or blank area 507 may be positioned adjacent to oval aperture 202 for the user to record or log dosage taken, time of day, day of week, or any other useful information.

The embodiment of FIG. 5 may be folded and placed into a casing comprising paperboard, or any other material, to protect the packaging and to prevent accidental and annoying unfolding. In a further alternative embodiment, left flap 503 may also comprise a blister similar to right flap 504. Left flap 503 and rear card 230 (FIGS. 2C and 2D) may also be extended, folded, printed on, or constructed to hold materials to achieve the desired functionality without departing from the spirit of the invention.

Ultimately, the preferred embodiment of the present invention may require the user to apply enough force on the blister either by hand or with a tool to effectively tear through both the score-cut and the perforated cut. Children will still have difficulty accessing the content of the blister because the foil is not exposed, yet this method is simple enough for competent individuals to understand, especially after reading the instructions. There is only one step necessary to follow in order to dispense the contents from the blister card package and it may be summarized as follows: 1) Using a tool or your hand push the product through the seal.

Advantageously, paperboard can be easily printed on. Therefore, logos, text, images, patterns, designs, and other marketing material may be printed directly on the packaging. This will make the blister card package more attractive to a consumer shopping at a retail location and increase the marketing potential of the product for the vendor. In addition, instructions for the product may also be printed on the paperboard. The method of manufacturing the preferred embodiment of the present invention includes a single step for applying release coatings and printed information, thus minimizing the cost of manufacturing. In the preferred embodiment, the printing occurs opposite the laminated side of the paperboard. Moreover, front card 201, rear card 230, or both, may be extended in one or more directions to provide additional area for printed information. Another advantage of paperboard is that it is easily written on, allowing a blister card package user to record information such as when medication was administered or side effects felt after taking the medication. In an alternative embodiment, one sheet of paperboard may be folded to create a front card, rear card and extended side.

Figure 6:
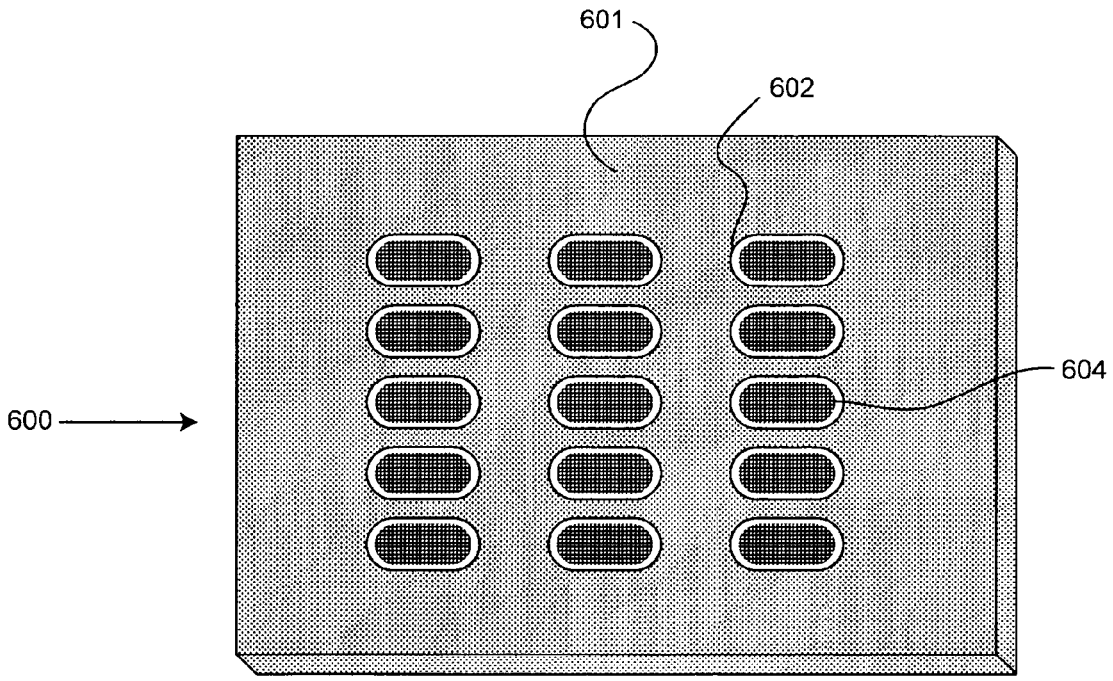
FIG. 6 depicts a front schematic view of a solid form blister in accordance with an alternate embodiment of the present invention.

Another embodiment of the present invention is depicted in FIG. 6. Solid-form blister 600 comprises a two-dimensional matrix of blisters 602 attached to base 601 and containing product 604. As with blister strip 100, the openings of blisters 602 are enclosed with seals (not shown) similar to seals 104 of FIG. 1B. Therefore, solid-form blister 600 can be encased between a front and rear card in the same manner described in the aforementioned embodiments of the present invention. Additionally, solid-form blister 600 essentially operates in the same manner as extensively described above, however has the capability to contain a larger capacity of blisters 102 as illustrated in FIG. 6.

Figure 7:
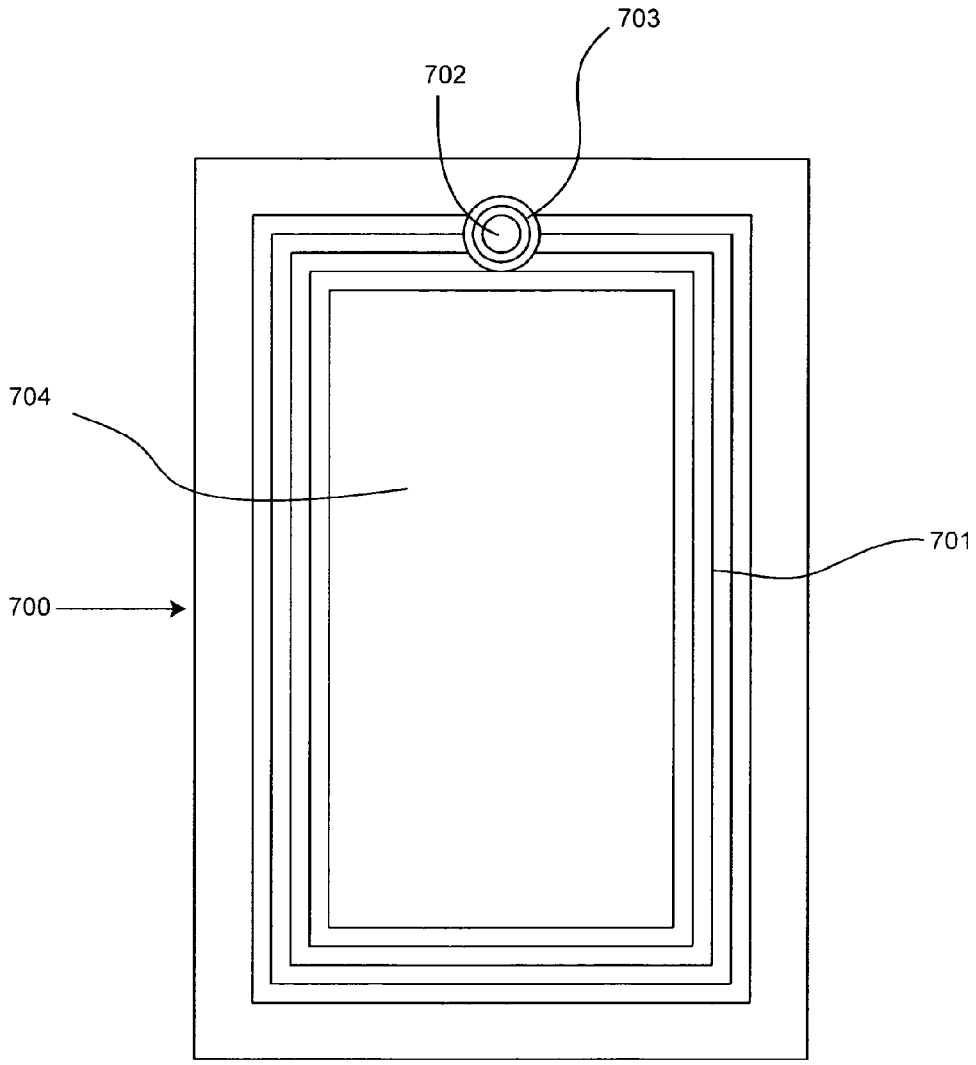
FIG. 7 depicts an alternate embodiment of the present invention adapted for use with security, audit, RFID, or consumer product tags.

Several other embodiments of the present invention are adapted for use with consumer and retail goods. FIG. 7 depicts a stiff paperboard tag 700 used to house a security or audit device, such as an RFID tag, security tag, product tag, sensor, or the like. Tag 700 may comprise multiple paperboard layers and be laminated to prevent tampering or degradation of the product or security device contained within tag 700 or tag 700 itself. It is also contemplated that tag 700 may be comprised of other suitable materials in addition to paperboard. At least one tear-stop cut 701 is added to the perimeter of tag 700 to prevent propagation of side tears. In addition, tear-stop cut 701 may also reduce puncture tears initiated from the center area 704 of tag 700. Center area 704 may securely house a security device, audit tag, product tag, RFID tag, or other like object to facilitate consumer product management or inventory control. The device or tag may be embedded or secured within the front and rear cards or paperboard layers of tag 700 or otherwise attached, glued, or affixed to tag 700.

Ideally, tag 700 may be placed within consumer goods and products without the knowledge of consumers to aid in asset management and inventory control. This way, tag 700 is not visible to consumers or potential thieves. Alternatively, tag 700 may contain adhesive or other attaching means, such as circular aperture 702 for tag 700 to be fastened, tied, or otherwise attached to a consumer or retail product via a product tie. Circular aperture 702 may also contain at least one tear-stop cut 703 concentric with circular aperture 702 to prevent ripping or pulling of tag 700 off the consumer product. For example, tag 700 may be utilized to automate checkout at a retail location (with the use of RFID tags, radio transmitters, or the like) or curb product theft.

Figure 8A:
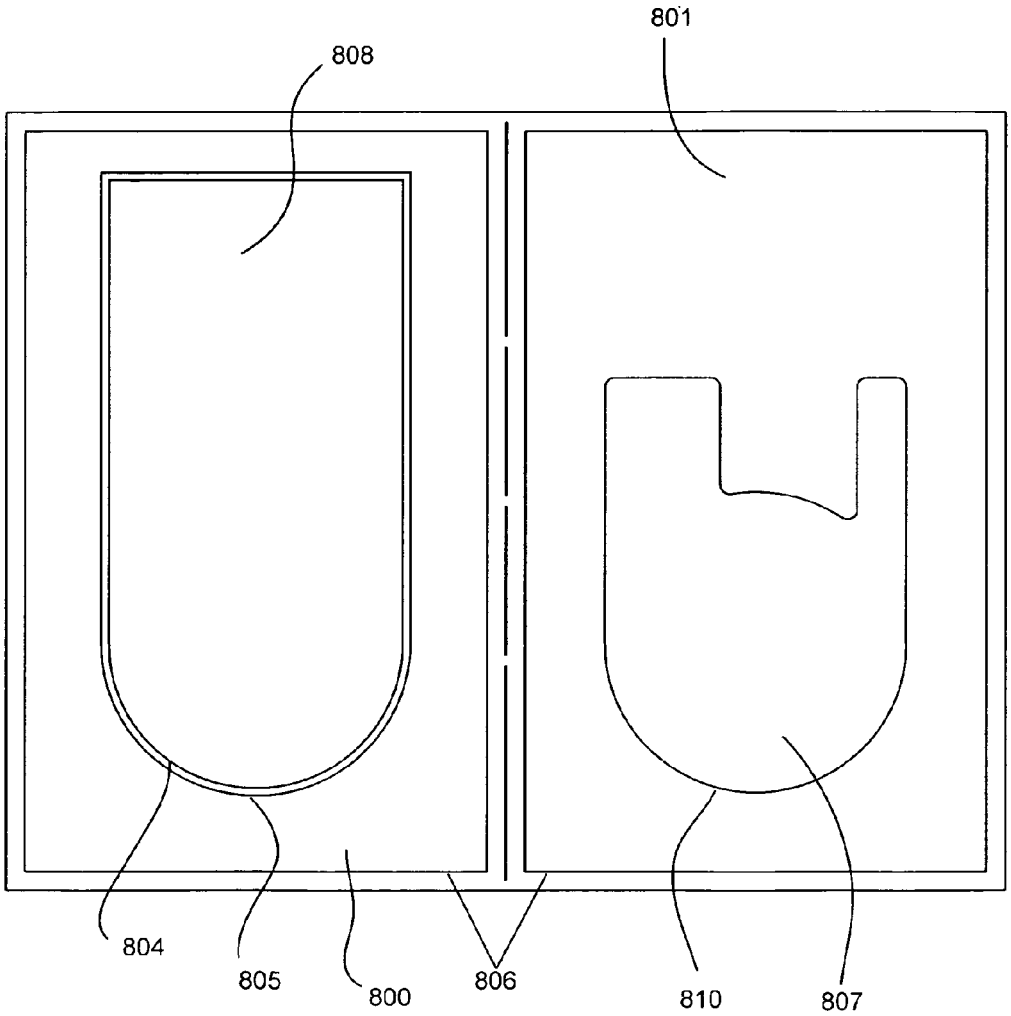
FIG. 8A depicts a schematic view of a foldable blister card in accordance with an alternate embodiment of the present invention adapted for consumer electronics products.

Another embodiment of the present invention adapted for consumer electronics accessories is depicted in the foldable blister card of FIG. 8A. Aperture 810 is cut from front card 801 conforming to the basic shape of a plastic blister 807 to be inserted between front card 801 and back card 800. Once blister 807 containing the product is inserted, back card 800 is folded behind front card 801. The two cards are then glued or sealed together with the application of heat and pressure, as described above, thereby securing the blister to the blister card. To open the package, a user applies pressure on blister 807, which is attached to aperture 810. This pressure pushes the product through to the back side removing panel 808. Cut-score 804 may be positioned slightly within perforated cut 805, allowing panel 808 to be removed from the package easily and cleanly when pressure is applied from the front side. Since the tears will follow the path of least resistance around the perimeter of the product, the product may be removed quickly, cleanly, and safely from its packaging in this manner. Safe and controlled removal of the product is especially important for electronics and electronics accessories, which may be expensive and fragile. Back card 800 and front card 801 additionally may be laminated and contain tear-stop cuts 806 along the perimeters of front card 801 and back card 800 to prevent the propagation of side tears as described in the previous embodiments.

Figure 8B:
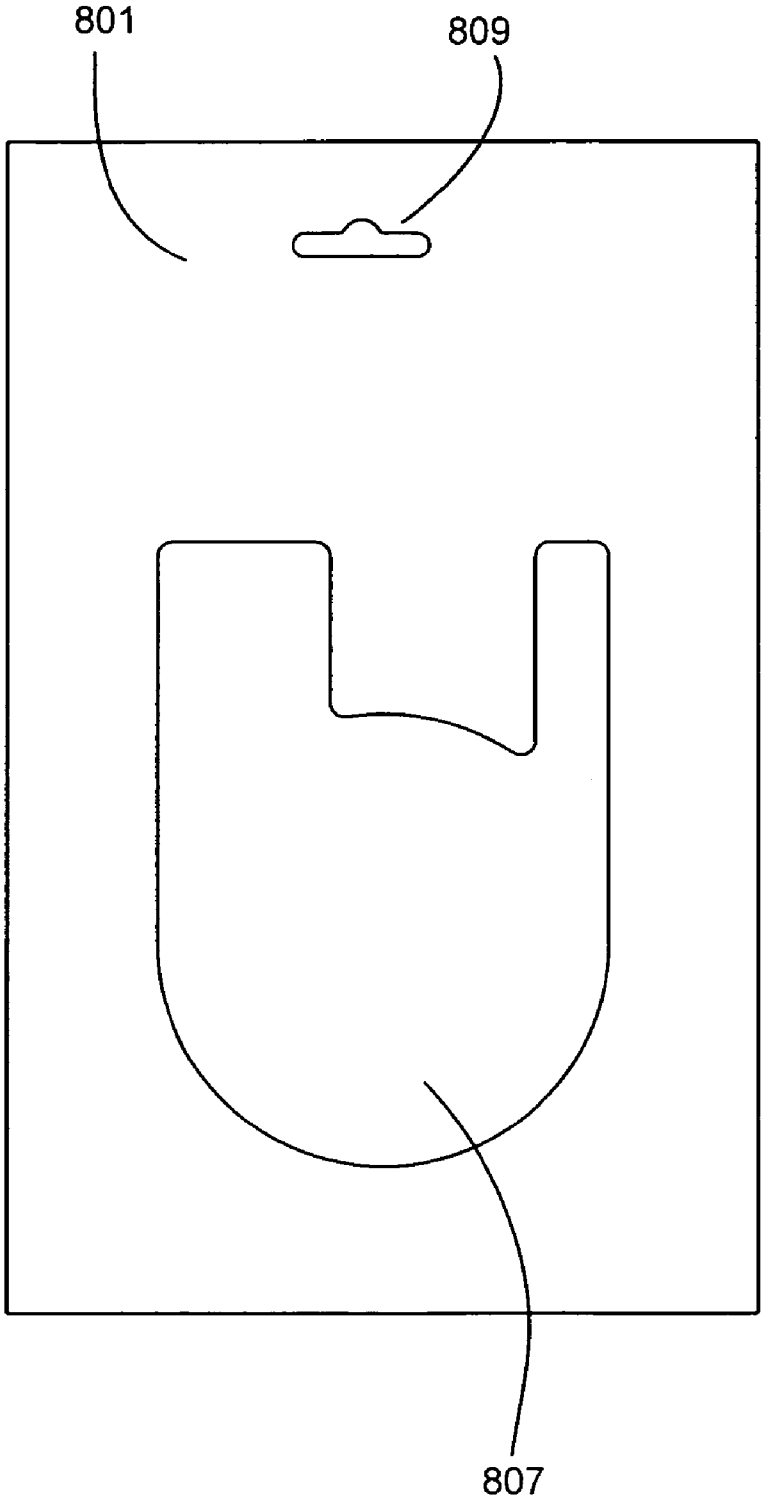
FIG. 8B depicts a front schematic view of the assembled blister card of FIG. 8A.

FIG. 8B shows the assembled, folded blister package of FIG. 8A. Blister 807 is preferably comprised of clear plastic for easy viewing of the product contained within blister 807. Printing may be located anywhere on front card 801 where convenient. Preferably, this printing describes the product contained within blister 807, its features, cost, and any other useful information for the consumer or retailer. Additionally, the package may comprise a hook aperture 809 for hanging multiple packages at a retail location.

Figure 9A:
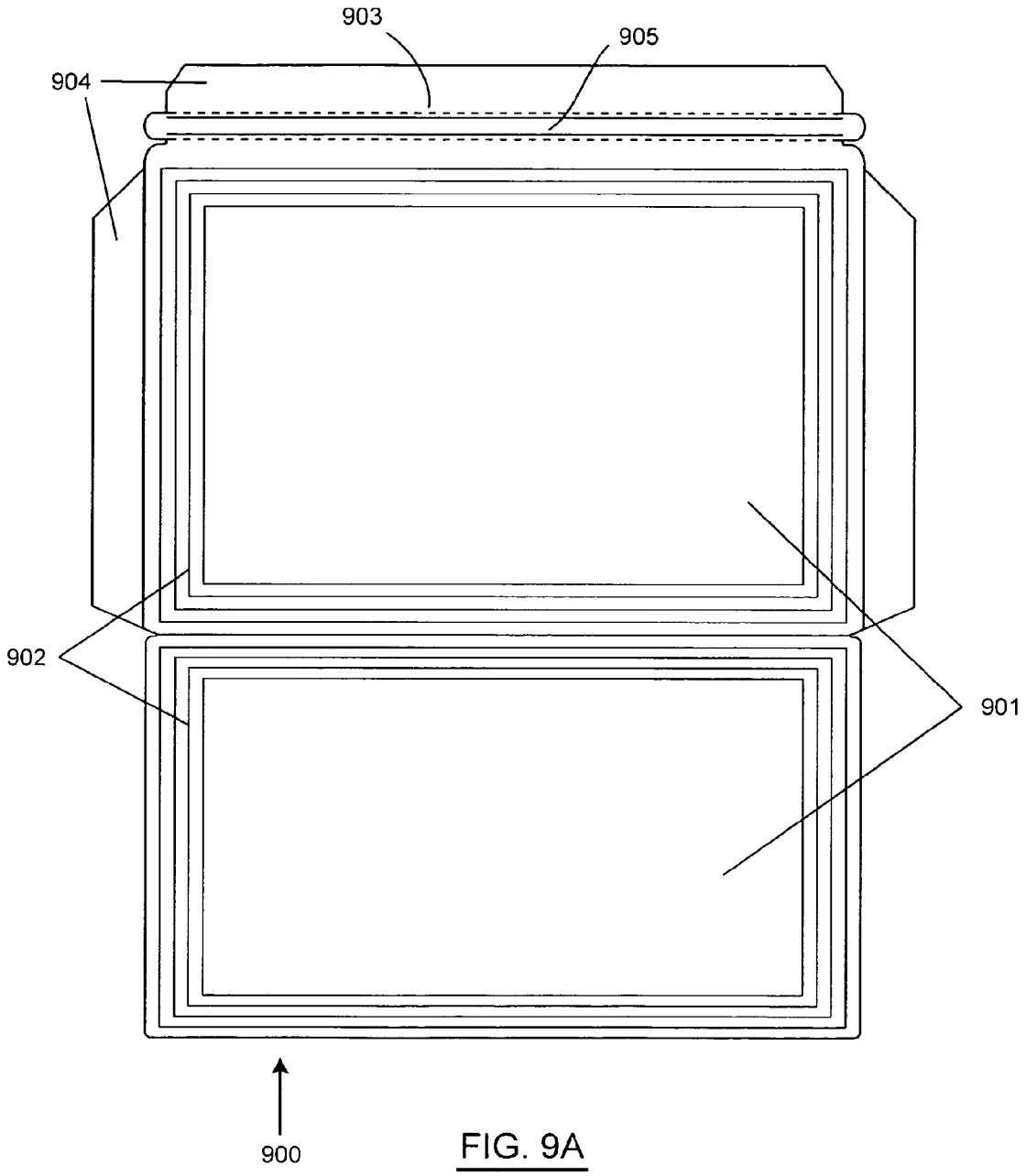
FIG. 9A depicts a schematic view of a foldable package card in accordance with an alternate embodiment of the present invention adapted for consumer postal products.
Figure 9B:
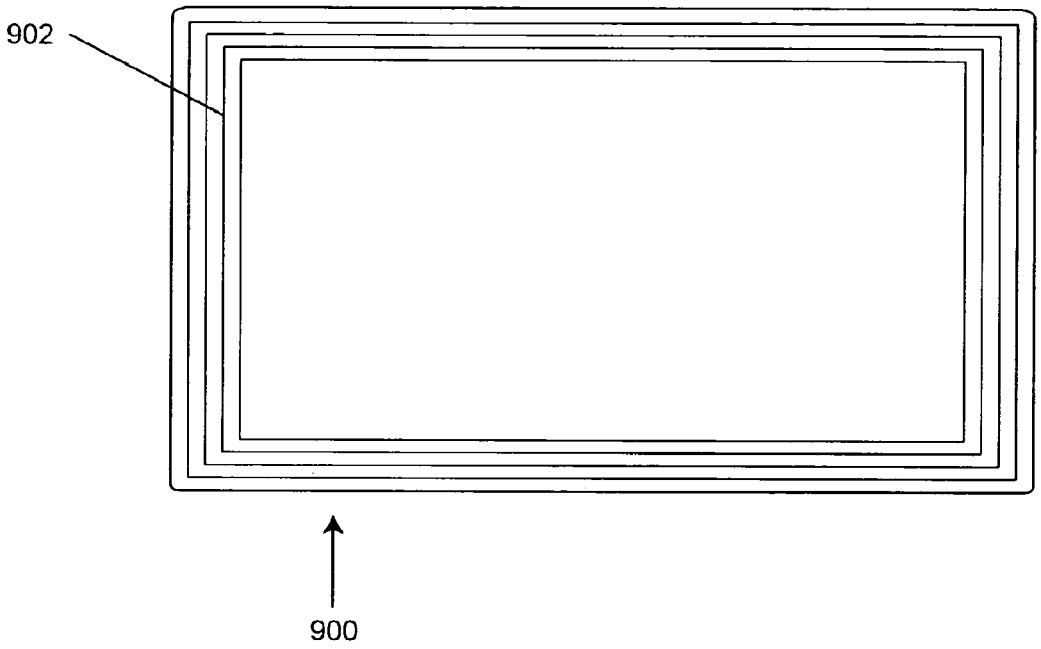
FIG. 9B depicts a front schematic view of the assembled package card of FIG. 9A.

Another alternative embodiment is illustrated in FIGS. 9A and 9B and is adapted for mailing applications. Envelope 900 is comprised of laminated paperboard, cardboard, PVC, or any other suitable material. Envelope 900 is laminated or embedded with plastic film 901, which could comprise biaxial film, plastic, polyester, PVC, or any like polymer. At least one tear-stop cut 902 is ideally positioned ¼ inch to ½ inch from all perimeter edges of envelope 900 to halt the propagation of any side tears in envelope 900. Plastic film 901 and tear-stop cut 902 will minimize any degradation of the product contained within envelope 900 during shipping and processing. In addition, plastic film 901 and tear-stop cut 902 create an effective deterrent from tampering or theft of the products contained within envelope 900. The number and location of tear-stop cut 902 can be varied as desirable. Tab edges 904 enclose the product, which in this case may be stationary to be mailed. Tab edges 904 may contain stamped adhesive (pressure sensitive, heat-activated, or the like) or glues to assist in securing envelope 900 around the product. Perforated cut 903 surrounds pull-tab 905 for easy access to the product after envelope 900 is sealed. In addition a cut-score may be positioned slightly within or outside the perimeter of perforated cut 903 to ensure a clean tear.

FIG. 9B shows the assembled envelope 900 of FIG. 9A. Depending on which side of envelope 900 is laminated, tear-stop cut 902 may be visible from the outside of assembled envelope 900 or tear-stop cut 902 may be hidden from view and only visible from inside envelope 900. Envelope 900 may come preassembled in pre-folded form or unfolded as depicted in FIG. 9A. If envelope 900 is preassembled, the user needs only to insert a product and seal envelope 900 by folding tab edge 904 over pull-tab 905 and securing tab edge 904 to envelope 900. A variety of glues, adhesives, or fasteners may be used to facilitate the sealing of envelope 900.

Figure 10A:
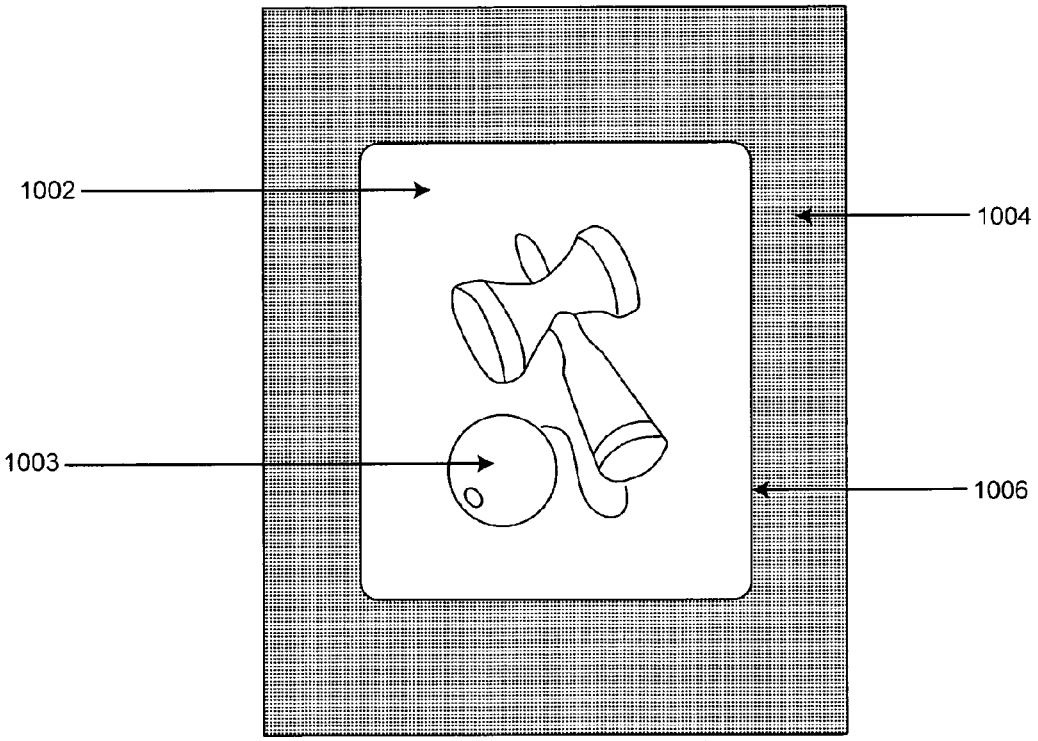
FIG. 10A depicts a front schematic view of a blister package in accordance with an alternate embodiment of the present invention adapted for small retail products.
Figure 10B:
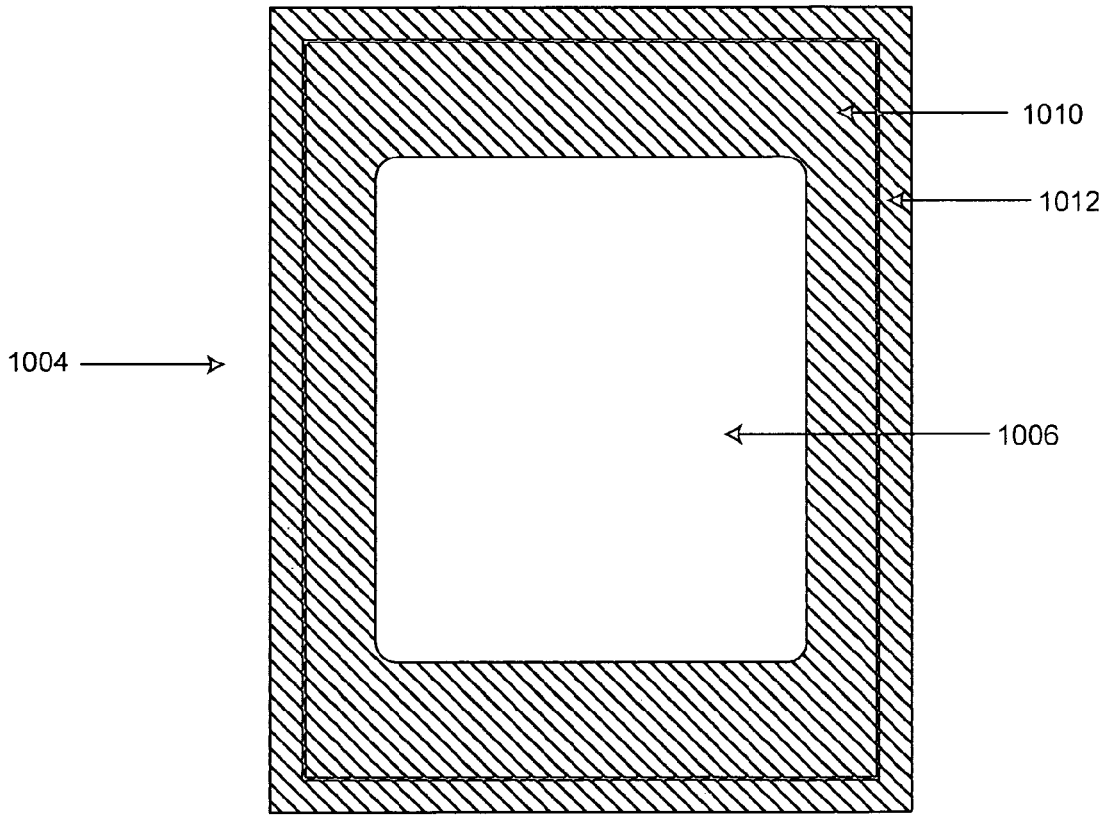
FIG. 10B depicts a rear schematic view of the front blister card of FIG. 10A.

A final embodiment of the present invention is illustrated in FIGS. 10A and 10B. Blister 1002 houses a small consumer product 1003, such as a child's toy. Front card 1004 is preferably composed of paperboard or stiff paper, although any suitable material may be used. In addition, front card 1004 may be laminated with a plastic material to resist tearing and product tampering (as discussed above). Front card 1004 contains blister aperture 1006, through which blister 1002 is placed. A rear view of front card 1004 is shown in FIG. 10B. Aperture 1006 is adapted to allow blister 1002 to pass through. Tear-stop cut 1012 is positioned along the outer perimeter of the back of front card 1004 and a plastic film 1010 covers the card. A rear card (not shown) is attached behind front card 1004 to complete the consumer product packaging. This arrangement maintains the child resistant and theft-resistant qualities of the card, while at the same time making tear-stop 1012 and film 1010 invisible to the consumer or user.

While the present invention has been described with reference to one or more preferred embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

The invention claimed is:

1. An apparatus for packaging at least two consumer products comprising:

a front panel having at least two apertures;

a rear panel having a removable section with at least two cuts along a perimeter of the removable section;

wherein a laminate material is applied to at least one surface of at least one of the front panel and the rear panel;

wherein the laminate material contains a cut-score; and wherein the laminate material contains a perforated cut.

2. An apparatus according to claim 1, further comprising:

at least one target area on the front panel that aligns with the removable section; and wherein the front panel and the removable section are configured so that pressure applied to the at least one target area causes the removable section to be at least partially removed from the rear panel.

3. An apparatus according to claim 1, wherein at least one of the at least two cuts provides a path to facilitate removal of the removable section.

4. An apparatus according to claim 1, wherein the perforated cut penetrates the laminate material.

5. An apparatus according to claim 1, wherein the perforated cut runs inside the edge of at least one of the front panel and the rear panel.

6. An apparatus according to claim 1, wherein each of the at least two apertures is adapted to fit a blister comprising a backing and at least one protrusion.

7. An apparatus for packaging at least two consumer products comprising:

a front panel having a first aperture and a second aperture;

a rear panel having a first removable section aligned with the first aperture and a second removable section aligned with the second aperture, wherein the rear panel comprises two cuts along a perimeter of the first removable section, and wherein the rear panel comprises two cuts along a perimeter of the second removable section;

a laminate material applied to the surface of at least one of the front panel and the rear panel, the laminate material comprising at least one perforated cut and at least one cut-score;

wherein the front panel and the rear panel are configured to hold at least a first blister and a second blister, wherein each of the first blister and the second blister comprises a backing and at least one protrusion containing a product.

8. An apparatus according to claim 7, wherein at least one of the front panel and the rear panel comprises printed matter.

9. An apparatus according to claim 7, wherein the at least one perforated cut penetrates the laminate material.

10. An apparatus according to claim 9, wherein the at least one perforated cut in the laminate material runs inside an exterior edge of at least one of the front panel and the rear panel.

11. An apparatus according to claim 7 wherein:

the laminate material comprises polyester; and the front panel and the rear panel comprise paperboard.

12. An apparatus according to claim 7, wherein:

at least one of the two cuts along a perimeter of the first removable section defines the first removable section; and wherein at least one of the two cuts along a perimeter of the first removable section facilitates removal of the first removable section.

13. An apparatus for packaging at least one consumer product comprising:

a front panel;

a rear panel coupled to the front panel, wherein the front panel and the rear panel are configured to hold at least one blister, the at least one blister comprising at least one protrusion containing a product;

a laminate material applied to the surface of at least one of the front panel and the rear panel, the laminate material comprising one or more perforated cuts and one or more cut-scores; and wherein at least one of the perforated cuts forms a pull tab in the laminate material.

14. The apparatus of claim 13, wherein the pull tab extends to the edge of the laminate material.

15. The apparatus of claim 13, wherein at least one of the one or more cut-scores is within a perimeter of the pull tab.

16. The apparatus of claim 13, wherein at least one of the one or more cut-scores is outside a perimeter of the pull tab.

17. An apparatus for packaging at least one consumer product comprising:

a front panel;

a rear panel coupled to the front panel, wherein the front panel and the rear panel are configured to hold at least one blister, the at least one blister comprising at least one protrusion containing a product;

a laminate material applied to a surface of at least one of the front panel and the rear panel, the laminate material comprising one or more cut-scores;

one or more perforated cuts disposed in at least one of the front panel, the rear panel and the laminate material; and wherein at least one of the perforated cuts forms a pull tab extending to the edge of the apparatus.

18. The apparatus of claim 17, wherein at least one of the one or more perforated cuts is disposed in the front panel, the rear panel, and the laminate material.

* * * * *